US010028586B2

(12) United States Patent
Schneider

(10) Patent No.: US 10,028,586 B2
(45) Date of Patent: Jul. 24, 2018

(54) SEAT WITH RELATIVE SYNCHRONOUS DISPLACEMENT BETWEEN BACK INCLINE AND SEAT INCLINE

(71) Applicant: Thomas Schneider, Schworstadt (DE)

(72) Inventor: Thomas Schneider, Schworstadt (DE)

(73) Assignee: Vitra Patente AG, Muttenz (CH)

( * ) Notice: Subject to any disclaimer, the term of this patent is extended or adjusted under 35 U.S.C. 154(b) by 337 days.

(21) Appl. No.: 14/436,414

(22) PCT Filed: Oct. 18, 2012

(86) PCT No.: PCT/CH2012/000238

§ 371 (c)(1),
(2) Date: Apr. 16, 2015

(87) PCT Pub. No.: WO2014/059553

PCT Pub. Date: Apr. 24, 2014

(65) Prior Publication Data

US 2015/0245714 A1 Sep. 3, 2015

(51) Int. Cl.
*A47C 1/03* (2006.01)
*A47C 3/30* (2006.01)
(Continued)

(52) U.S. Cl.
CPC ..... *A47C 1/03272* (2013.01); *A47C 1/03238* (2013.01); *A47C 1/03255* (2013.01);
(Continued)

(58) Field of Classification Search
CPC ..... A47C 1/03238; A47C 1/03255; A47C 1/03266; A47C 1/03288; A47C 1/03272;
(Continued)

(56) References Cited

U.S. PATENT DOCUMENTS 3,711,054 A * 1/1973 Bauer ..... A47C 3/30 248/161
4,889,385 A * 12/1989 Chadwick ..... A47C 3/026 297/285
(Continued)

FOREIGN PATENT DOCUMENTS

DE 35 30 868 A1 3/1987
DE 3827057 A1 * 2/1990 ..... A47C 1/03255
(Continued)

OTHER PUBLICATIONS

Machine Translation of DE3827057 from https://worldwide.espacenet.com/; May 25, 2017.*
(Continued)

*Primary Examiner* — Ryan D Kwiecinski
(74) *Attorney, Agent, or Firm* — McCarter & English, LLP

(57) ABSTRACT

The chair is of the type with mutually synchronous adjustment between back inclination and seat inclination, namely via a region between a respective zero position of back inclination ($R_0$) and seat inclination ($S_0$) and a respective maximum back inclination and seat inclination. The chair has a substructure (1) which is intended for placing on the floor and on which a base (2) is fastened rigidly. A seat support (6) which has a seat region and a back region is connected to the base (2). Furthermore, the chair includes two backrest bows (3) which are deflectable differently with respect to each other and are fastened on one side to the base (2) and on the other side to the back region of the seat support (6). The two backrest bows (3) are coupled independently of each other to the base (2) on a stationary first axis of rotation (D1). The seat region of the seat support (6) is coupled to the base (2) on a stationary second axis of rotation (D2). The two backrest bows (3) are coupled independently of each other to the back region of the seat
(Continued)

Figure 1A:
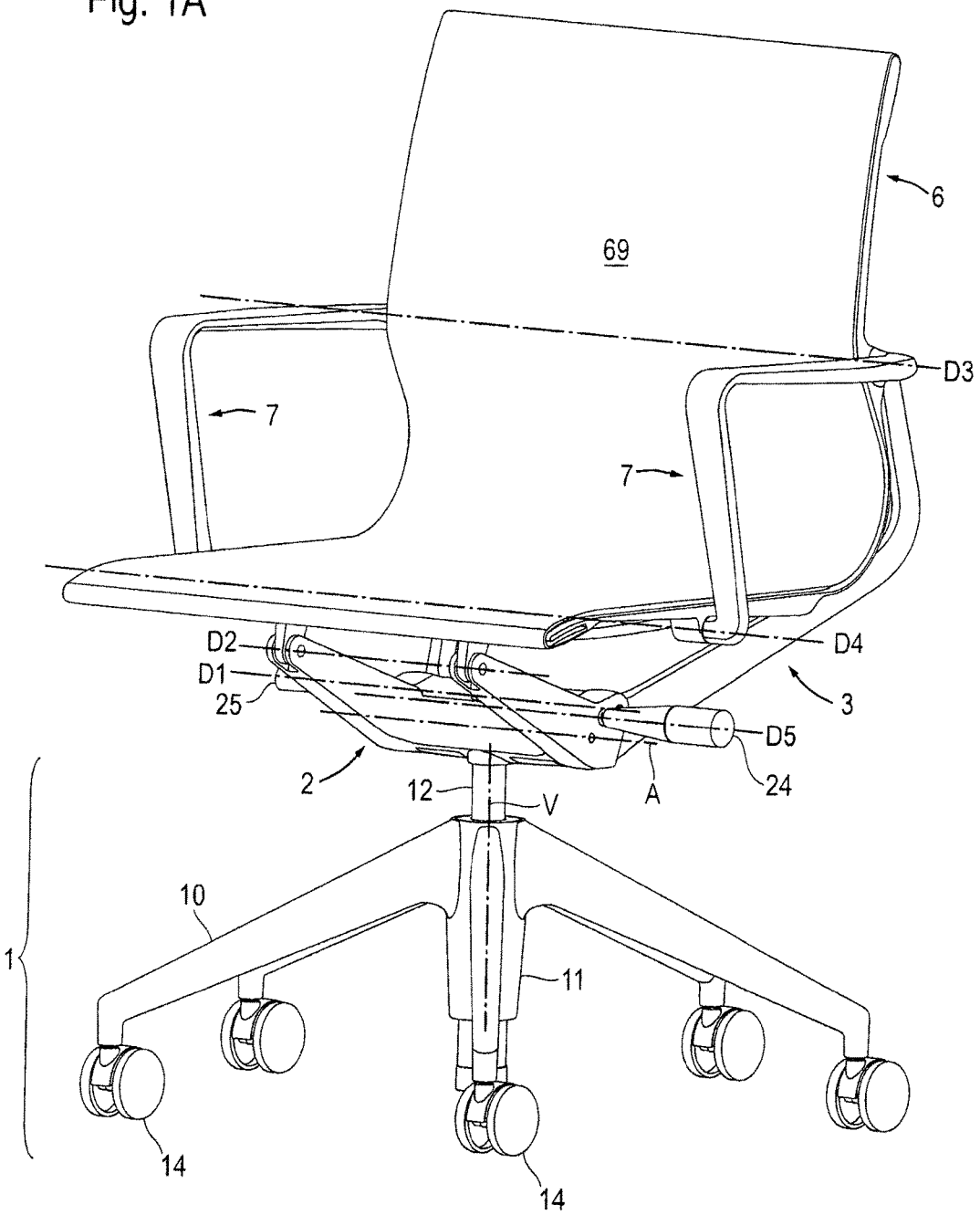

support (6) on an elastically deformable third axis of rotation (D3). The back region of the seat support (6) is twistable elastically. The seat support is covered with a cover. In the configuration as an office swivel chair, a height-adjustable pneumatic spring (12) on which the base (2) rests in order to adjust the seat support (6) to a height corresponding to a user's needs and in order to configure said seat support (6) to be rotatable about a vertical axis (V) is arranged in the substructure (1).

11 Claims, 24 Drawing Sheets

(51) Int. Cl.
*A47C 7/44* (2006.01)
*A47C 1/032* (2006.01)

(52) U.S. Cl.
CPC ..... *A47C 1/03266* (2013.01); *A47C 3/30* (2013.01); *A47C 7/44* (2013.01)

(58) Field of Classification Search
CPC ..... A47C 1/03261; A47C 3/026; A47C 3/027; A47C 3/30; A47C 7/004; A47C 7/44; A47C 7/54
See application file for complete search history.

(56) References Cited

U.S. PATENT DOCUMENTS

| | | | | |
|---|---|---|---|---|
| 5,713,632 | A | 2/1998 | Su | |
| 6,149,236 | A * | 11/2000 | Brauning | A47C 1/031 297/301.1 |
| 2002/0084687 | A1 * | 7/2002 | Gaylord | A47C 7/282 297/452.13 |
| 2003/0132652 | A1 * | 7/2003 | Caldwell | A47C 3/025 297/258.1 |
| 2007/0108822 | A1 * | 5/2007 | Ueda | A47C 1/03255 297/301.6 |
| 2007/0108831 | A1 * | 5/2007 | Ueda | A47C 1/03255 297/452.29 |
| 2009/0127914 | A1 * | 5/2009 | Igarashi | A47C 7/40 297/452.46 |
| 2013/0082499 | A1 * | 4/2013 | Schmitz | A47C 1/03255 297/285 |
| 2015/0230608 | A1 * | 8/2015 | Unwalla | A47C 1/03255 297/325 |
| 2016/0235203 | A1 * | 8/2016 | Rechtien | A47C 1/024 |

FOREIGN PATENT DOCUMENTS

| | | | | |
|---|---|---|---|---|
| DE | 3827057 | A1 * | 2/1990 | A47C 1/03255 |
| DE | 10 2011 105 290 | A1 | 12/2011 | |
| EP | 0 347 538 | A1 | 12/1989 | |
| EP | 0815778 | A1 * | 1/1998 | A47C 1/03255 |
| EP | 0815778 | A1 * | 1/1998 | A47C 1/03255 |
| EP | 0815778 | B1 * | 2/1998 | A47C 1/03255 |
| EP | 1 401 306 | B1 | 2/2007 | |
| EP | 2100539 | A1 * | 9/2009 | A47C 1/03255 |
| EP | 1 946 676 | B1 | 3/2011 | |
| JP | 10-151033 | A | 6/1998 | |
| WO | WO 2007/110729 | A2 | 10/2007 | |

OTHER PUBLICATIONS

Office Action dated Aug. 10, 2016, issued by European Patent Office issued in connection with European Patent Application No. EP12780635.4 (6 pages).
International Search Report of the International Searching Authority dated Dec. 10, 2012, issued in connection with International Application No, PCT/CH2012/000238 (6 pages).
International Search Report of the International Searching Authority dated Oct. 12, 2012, issued in connection with International Application No. PCT/US2012/000238 (6 pages).

* cited by examiner 60
640
62
6
64
D3
72
7
74
620
60
78
71
68
62
640
D4
75
61
620
624
615
74
67
610
68
72
60
D2
63
630
7
633
61
78
615
610
71
3
60
66
75
D3
D1
25
3
2
1
12
224
24
A
D5
D2
224
10
11
V
14

640
64
640
60
60
6
62
62
620
D3
7
624
7
74
72
78
68
71
72
68
78
67
61
D4
610
71
63
610
615
D2
633
60
75
61
630
60
D3
3
3
2
24
D1
V
1
12
25
A
D5
224
D2
224
11
10
14

Fig. 3C
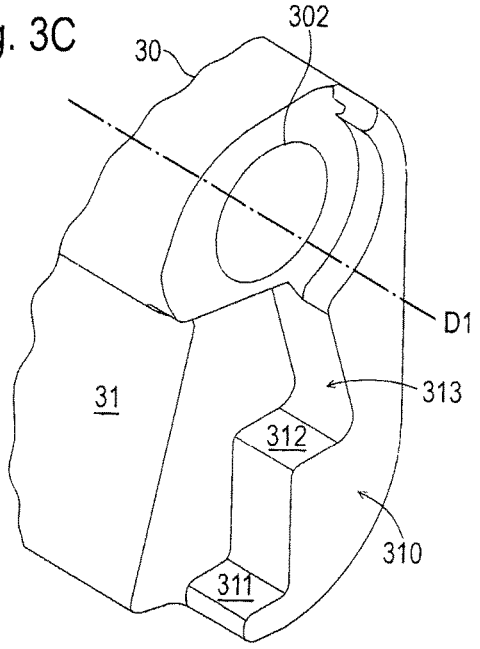
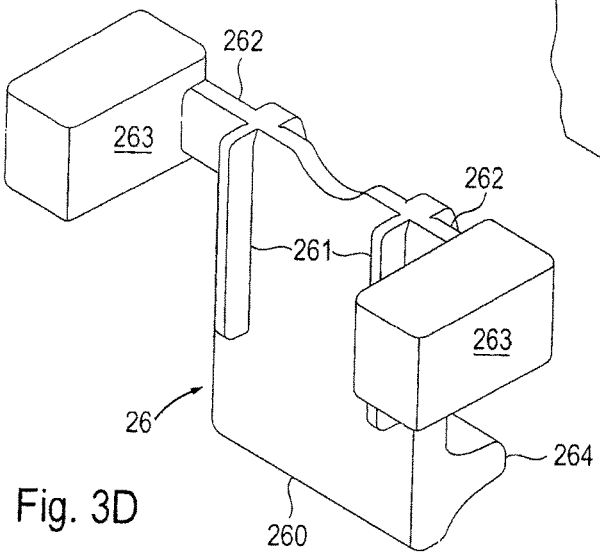
Fig. 3D
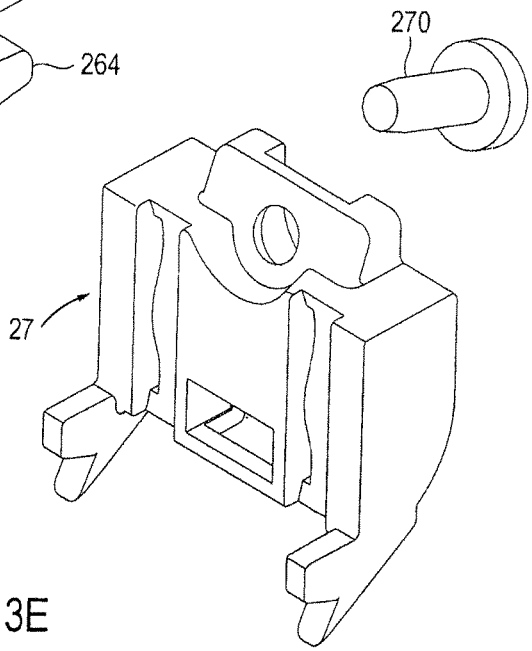
Fig. 3E

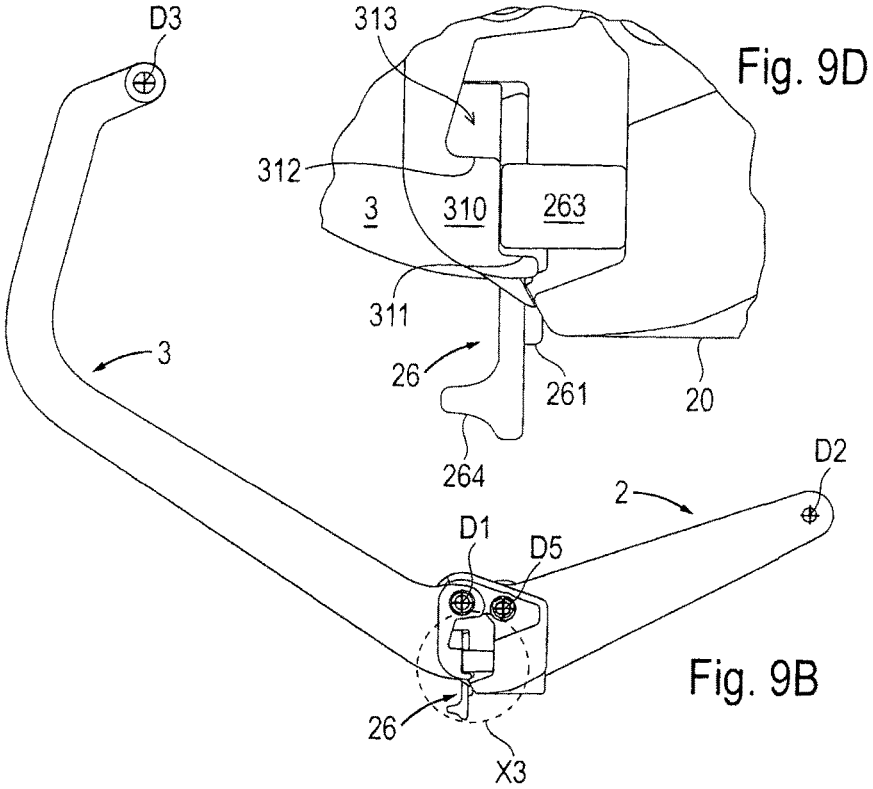
Fig. 9D
Fig. 9B
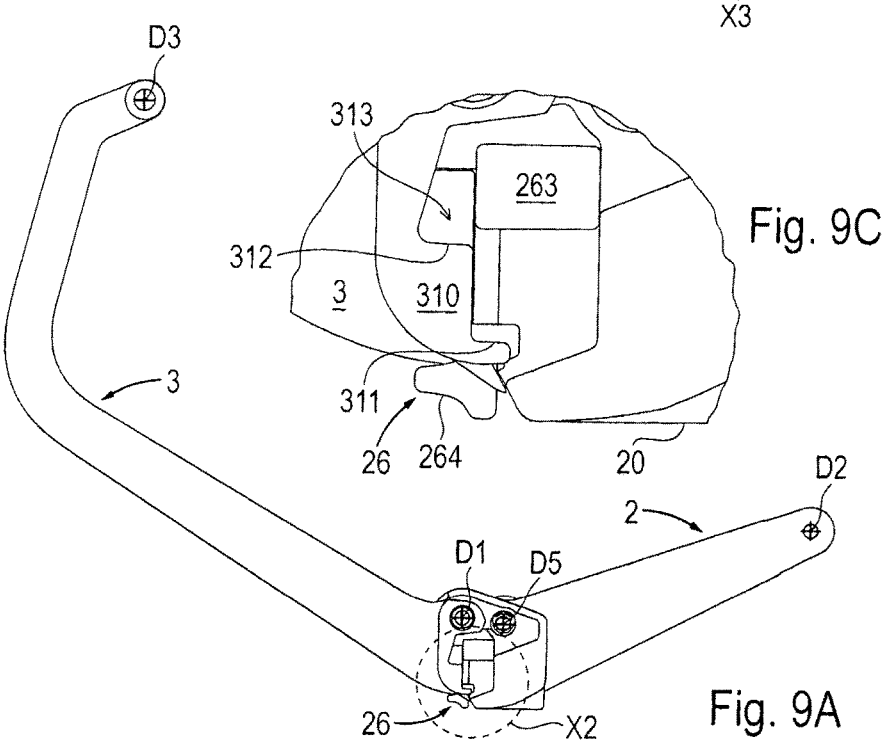
Fig. 9C
Fig. 9A

SEAT WITH RELATIVE SYNCHRONOUS DISPLACEMENT BETWEEN BACK INCLINE AND SEAT INCLINE

FIELD OF APPLICATION OF THE INVENTION

The present invention relates to a chair with mutually synchronous adjustment between back inclination and seat inclination from a zero position with the backrest basically standing vertically until a maximum inclination. The chair has a substructure which is intended for placing on the floor and on which a base is fastened rigidly. A seat support which has a seat region and a back region is connected to the base. Furthermore, the chair includes two backrest bows which are deflectable differently with respect to each other and are fastened on one side to the base and on the other side to the back region of the seat support. The seat support is covered with a cover. In the configuration as an office swivel chair, a height-adjustable pneumatic spring on which the base rests in order to adjust the seat support to a height corresponding to a user's needs and in order to configure said seat support to be rotatable about a vertical axis is arranged in the substructure.

PRIOR ART

Patent publications JP 10 151 033 A and U.S. Pat. No. 5,713,632 disclose chair constructions with a seat surface which is divided into two perpendicularly to the front of the chair in order to enable the seat surface to be deflected with a lateral inclination.

EP 1 401 306 B1 discloses a chair with a seat and a backrest, both of which consist of a number of elements which are movable independently with respect to one another and are joined to one another in the manner of a modular unit. The division of the elements runs parallel to the front of the chair, and the individual elements are deflected with a different intensity and lateral inclination depending on the shifting of the user's weight.

The subject matter of WO 2007/110 729 A2 is a chair, the backrest of which has two elastic side struts with a rib structure. When the backrest is loaded asymmetrically, the side struts are deflected differently.

The chair according to EP 1 946 676 B1 permits a mutually synchronous adjustment between back inclination and seat inclination, via a region between a respective zero position of back inclination and seat inclination and a respective maximum back inclination and seat inclination. A base is fastened rigidly on the substructure intended for placing on the floor. A seat support which has a seat region and a back region is connected to the base. Two backrest bows which are deflectable differently with respect to each other are fastened on one side to the base and on the other side to the back region of the seat support, and therefore a cushioned lateral inclination of the seat is made possible.

OBJECT OF THE INVENTION

Starting from the conditions of a mutually synchronous adjustment between back inclination and seat inclination on a chair and also asymmetric lateral deflection, the invention is based on the object of proposing a construction which is improved for series production and for ergonomically optimum use properties of the chair. Notable aspects here are use of material as efficiently as possible, productive assembly in series manufacturing, ease of service with minimum outlay on maintenance and the possibility of an aesthetic design of the chair.

OVERVIEW OF THE INVENTION

The chair is of the type with mutually synchronous adjustment between back inclination and seat inclination, namely via a region between a respective zero position of back inclination and seat inclination and a respective maximum back inclination and seat inclination. The chair has a substructure which is intended for placing on the floor and on which a base is fastened rigidly. A seat support which has a seat region and a back region is connected to the base. Furthermore, the chair includes two backrest bows which are deflectable differently with respect to each other and are fastened on one side to the base and on the other side to the back region of the seat support. The two backrest bows are coupled independently of each other to the base on a stationary first axis of rotation. The seat region of the seat support is coupled to the base on a stationary second axis of rotation. The two backrest bows are coupled independently of each other to the back region of the seat support on an elastically deformable third axis of rotation. The back region of the seat support is twistable elastically.

Special embodiments of the invention are defined below: a first spring unit which acts against the respective movable backrest bow is provided on the chair. A second spring unit which is supported on one side on the base in a stationary abutment and which acts on the other side against the respective movable backrest bow is present in a parallel connection to the first spring unit.

The first spring unit is adjustable and comprises two separate first spring elements. The second spring unit comprises two separate second spring elements. The base is a U-shaped housing with a central part and two limbs extending therefrom in the manner of arms. A second spring element is arranged in each of the limbs. The first axis of rotation runs through the central part while the second axis of rotation extends through the free ends of the two limbs.

The seat support comprises two struts which extend over the seat region and the back region. Upper connecting members through which the third axis of rotation runs are present on the two struts in the back region. Central connecting members through which a fourth axis of rotation runs are present on the two struts in the seat region. A first cross strut on which front connecting members are located, through which the second axis of rotation runs, is arranged between the two struts in the seat region.

The first cross strut is arranged at the front in the seat region, and a second cross strut extends between the two struts at the rear in the seat region. The back region is spanned between the two struts by a back bow. The two struts, the two cross struts and the back bow form the seat support as individual parts which are joined together, or the seat support is produced integrally as an injection molded plastics part. Each strut has a region of elasticity between the seat region and the back region.

The chair can be provided with armrests, of which each armrest is articulated on one side on the third axis of rotation and on the other side on the fourth axis of rotation. Each armrest has a bearing region basically extending horizontally from the third axis of rotation and a support region extending upward from the fourth axis of rotation. There is a transition between the bearing region and the support region. During the movement of the chair into the maximum back inclination and seat inclination, the armrests support the damping effect of the first spring unit and of the second spring unit. During the movement of the chair back in the direction of the zero position of back inclination and seat inclination, the armrests support the restoring force of the two spring units. The armrests are produced integrally as an injection molded plastics part.

A stationary fifth axis of rotation on which a pre-adjustment mechanism for adjusting the intensity of the first spring unit is arranged extends through the base. The individual first spring element is a block-shaped body made of elastomer which is arranged on the extension of each backrest bow. Two displaceable pressure pieces, of which in each case one of the pressure pieces is assigned to one of the first spring elements, are arranged along the fifth axis of rotation on the pre-adjustment mechanism. The pressure pieces can be aligned with the two first spring elements with a selectable degree of congruence by actuation of the pre-adjustment mechanism in order, during movement of the chair into the maximum back inclination and seat inclination, to obtain the desired damping in accordance with the portions of the first spring elements that are squashed between the extensions and the pressure pieces, together with the effect of the second spring unit.

The second spring elements of the second spring unit are helical compression springs. Every second spring element is provided with an end piece which has a fixing member which receives one end of the spring element and therefore a spring assembly is produced. A sixth axis of rotation on which the end pieces of the two spring assemblies are articulated extends through the extensions of the two backrest bows.

The struts of the seat support have a groove which runs longitudinally and in which a cover for stretching over the seat support can be fixed.

A height-adjustable pneumatic spring on which the base rests in order to adjust the seat support to a height corresponding to a user's needs and in order to configure said seat support to be rotatable about a vertical axis is arranged in the substructure.

BRIEF DESCRIPTION OF THE ATTACHED DRAWINGS

Figure 1B:
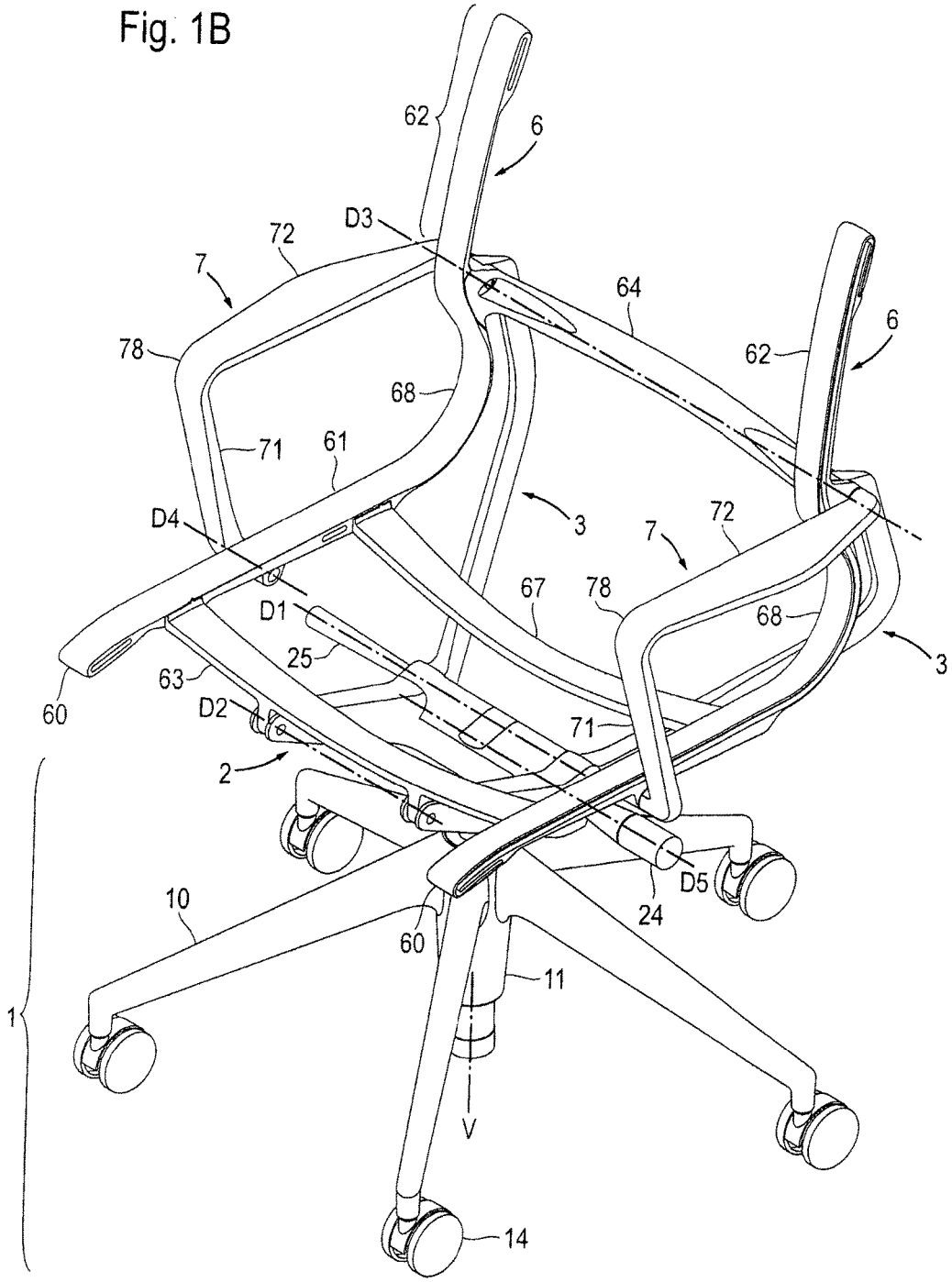
Figure 1C:
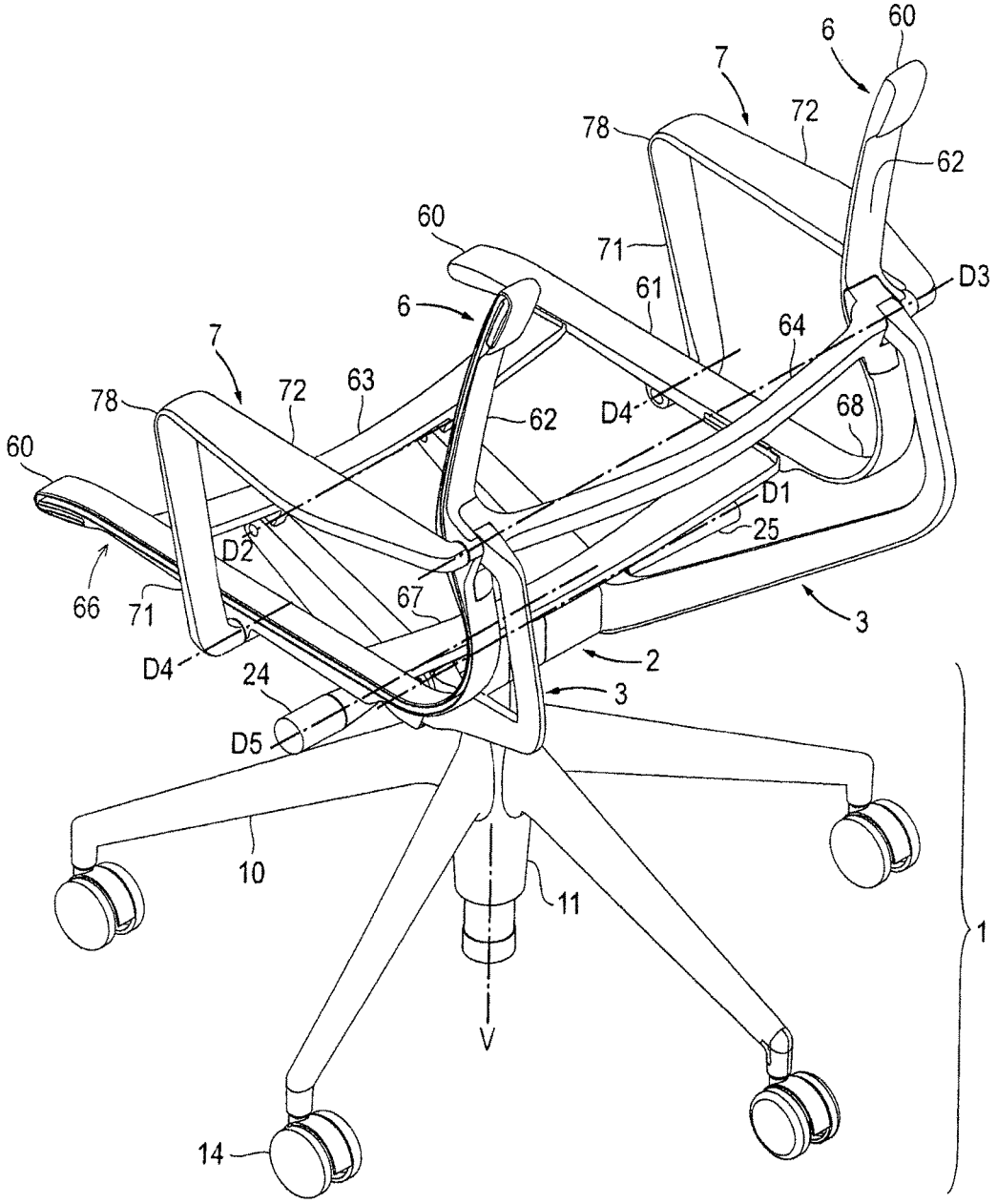
Figure 1D:
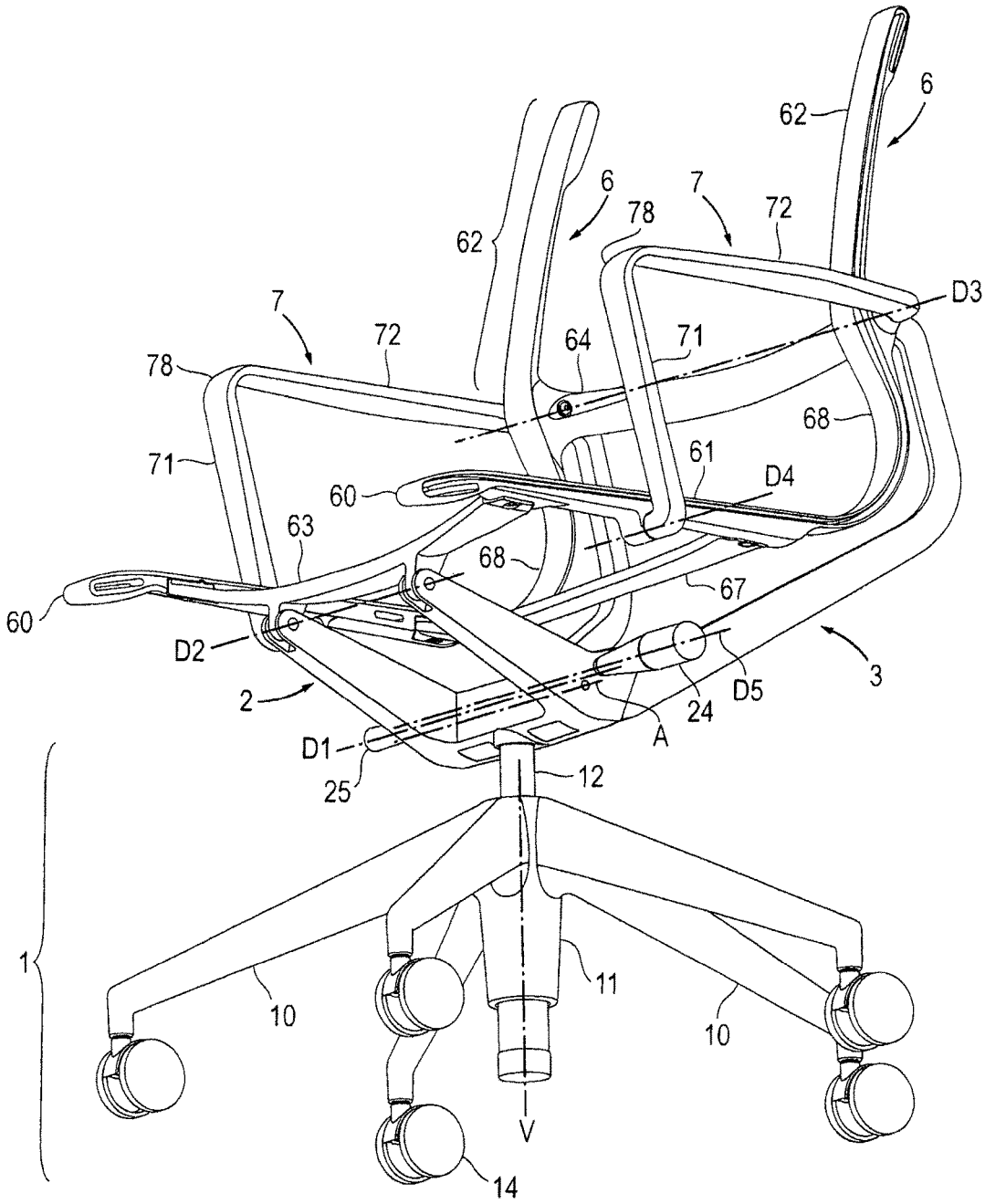
Figure 1E:
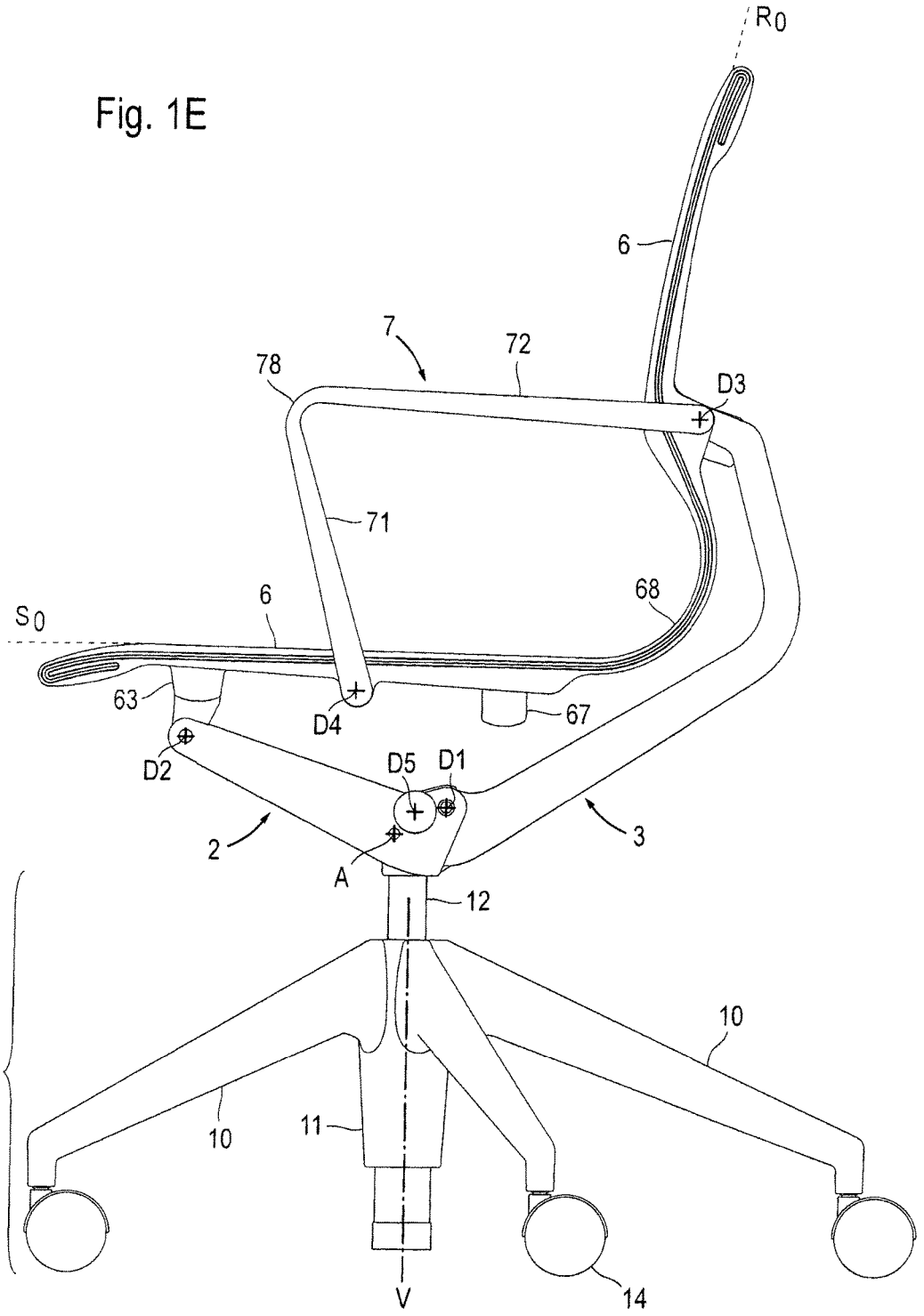
Figure 1F:
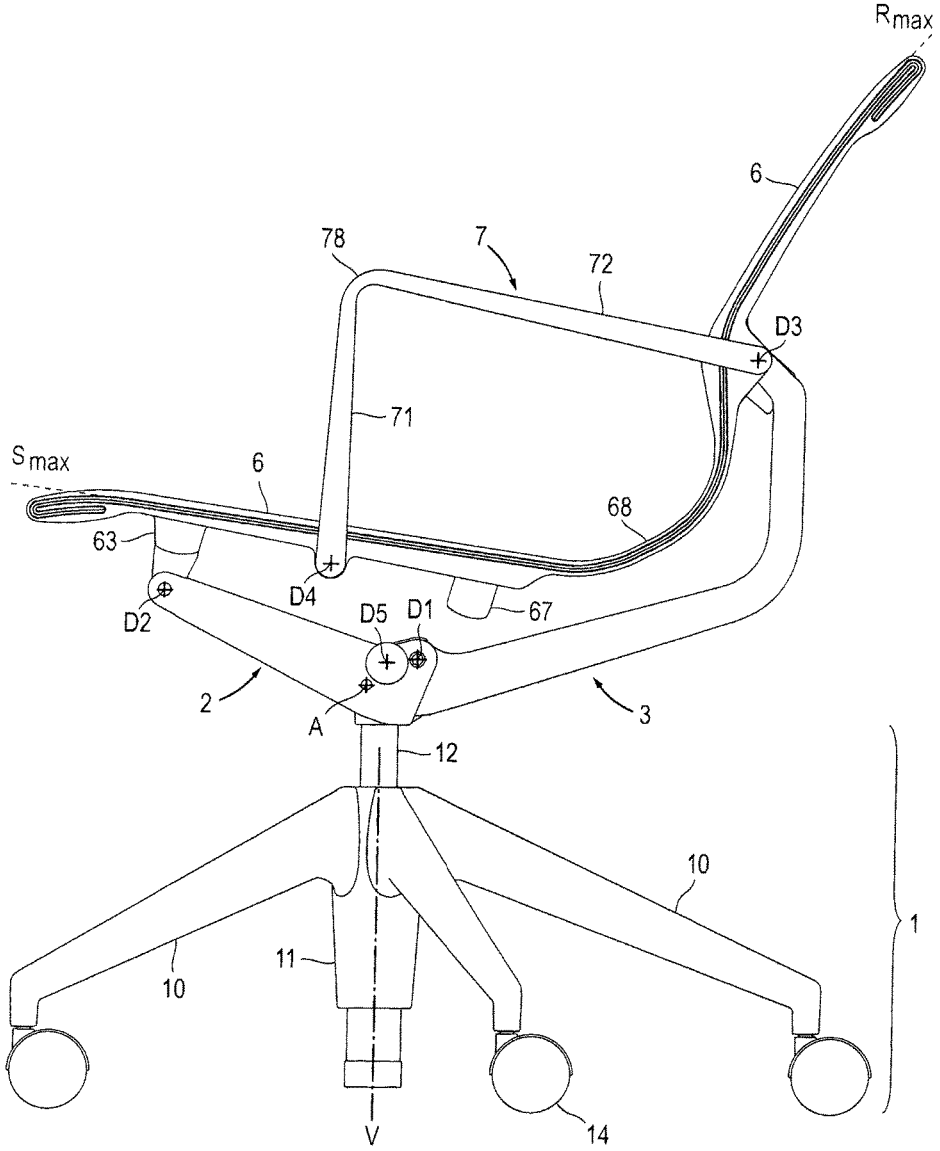
Figure 2A:
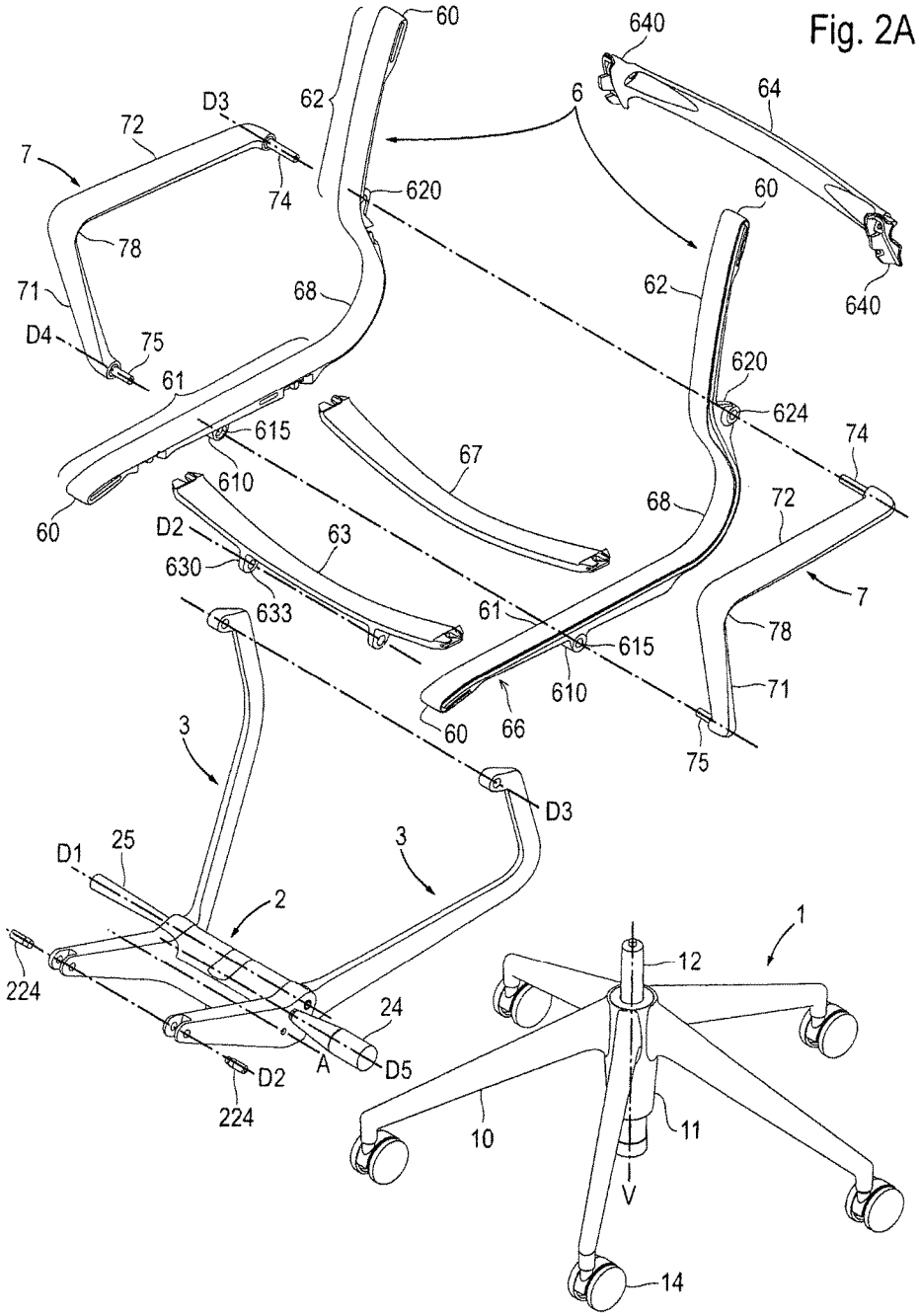
Figure 2B:
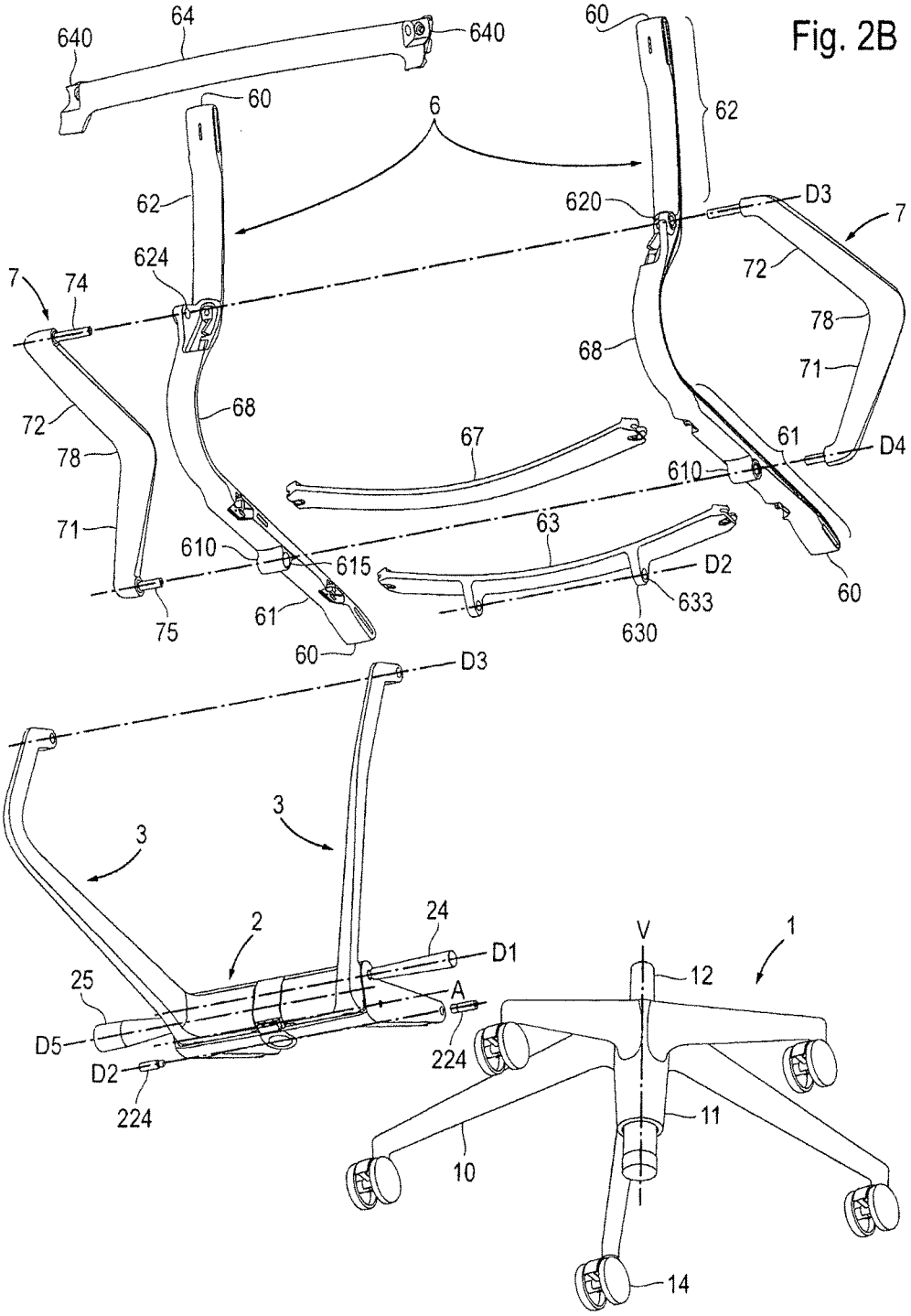
Figure 3A:
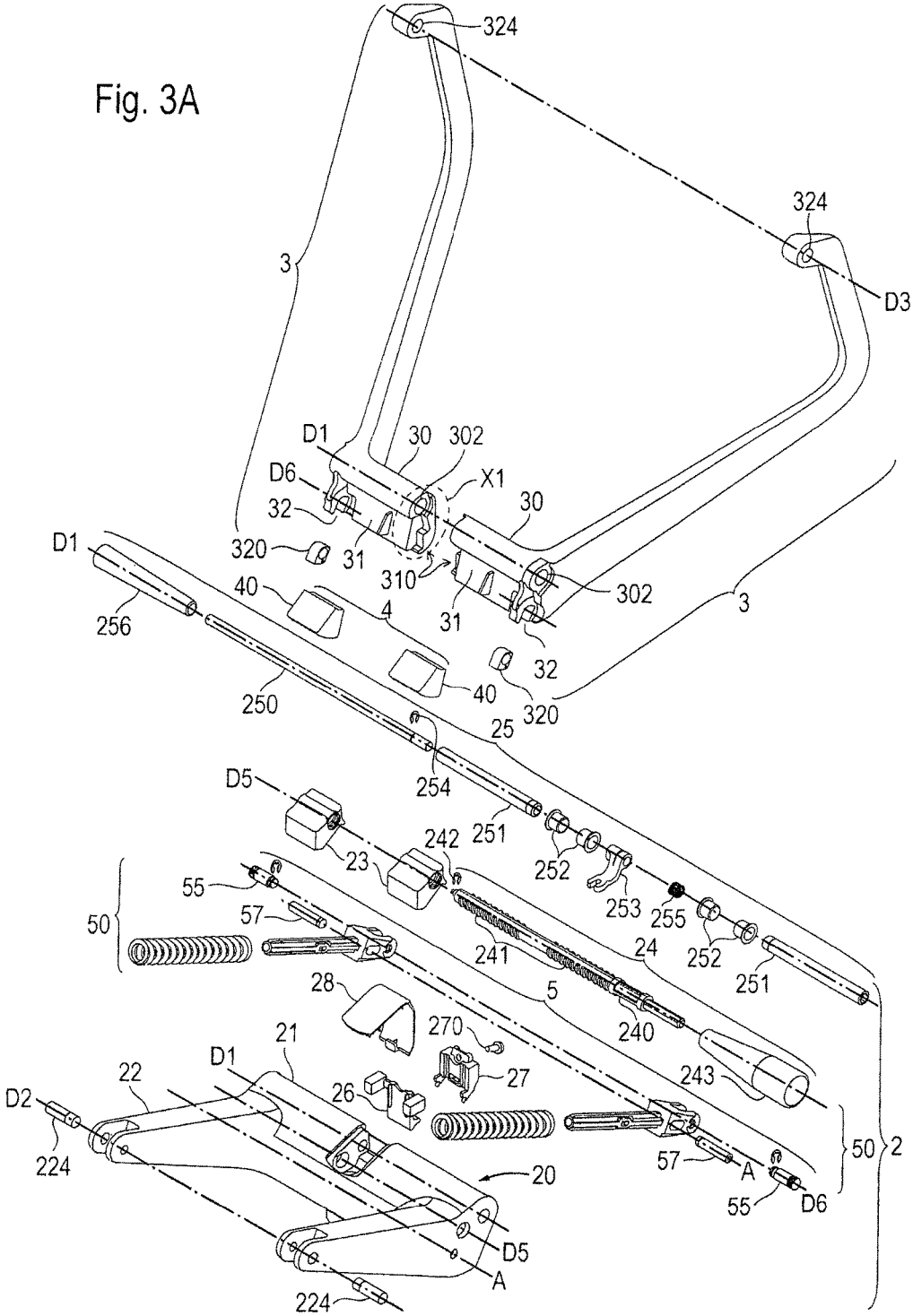
Figure 3B:
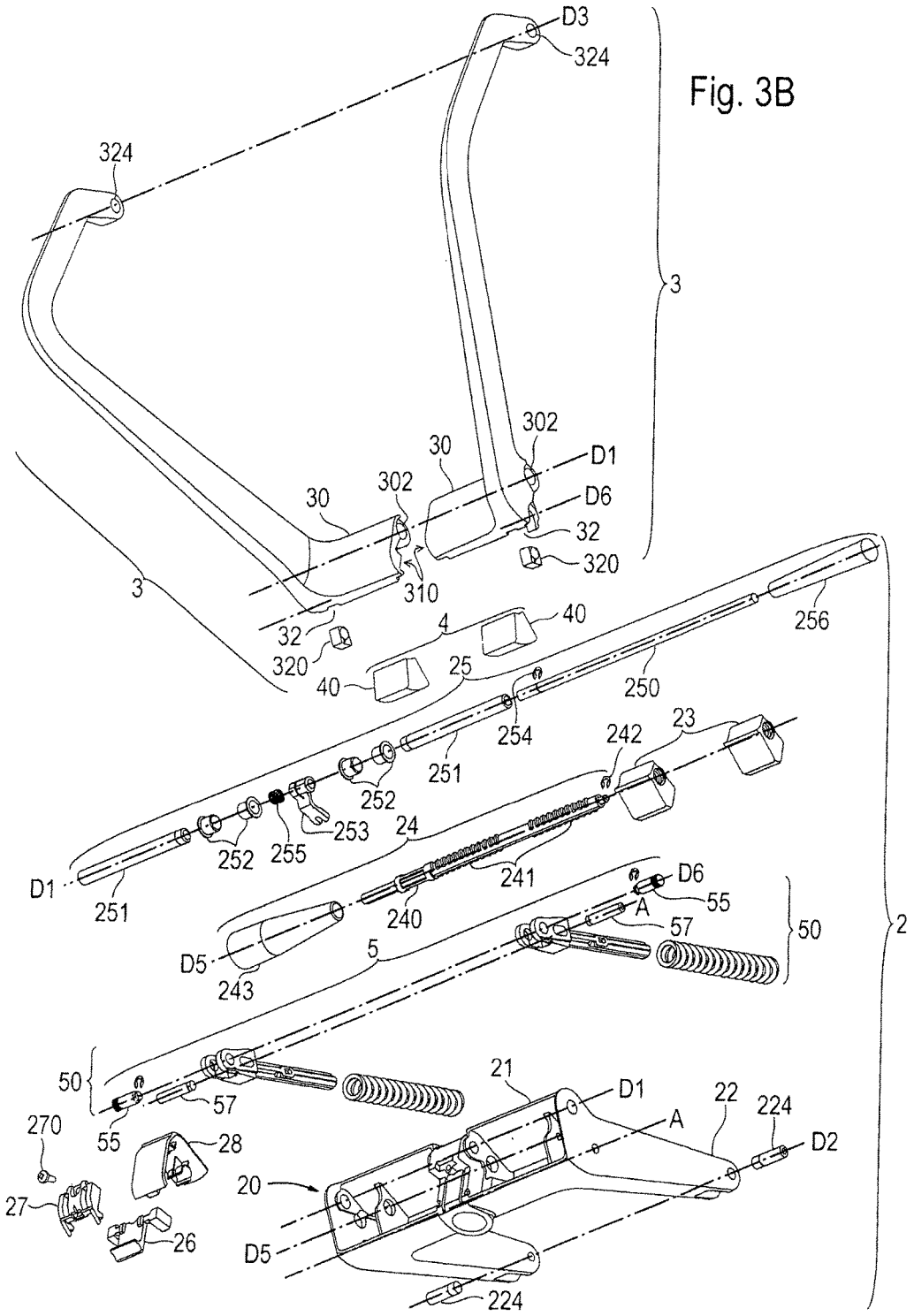
Figure 4A:
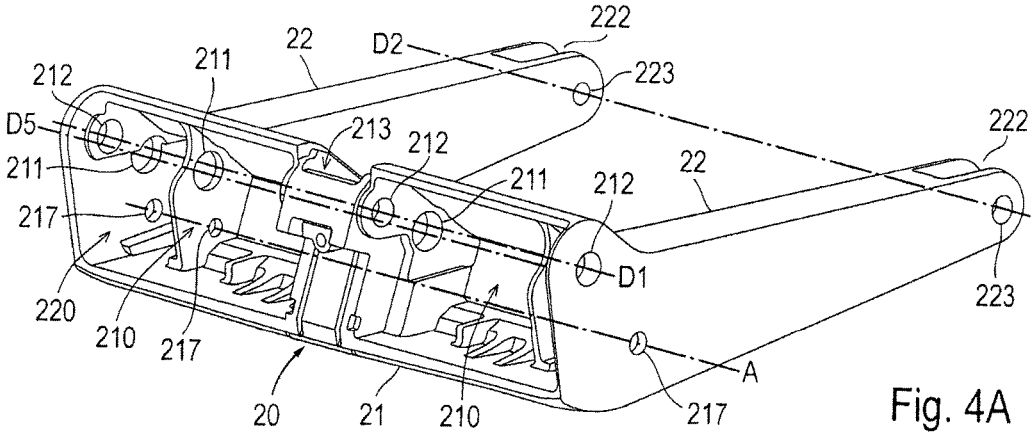
Figure 4B:
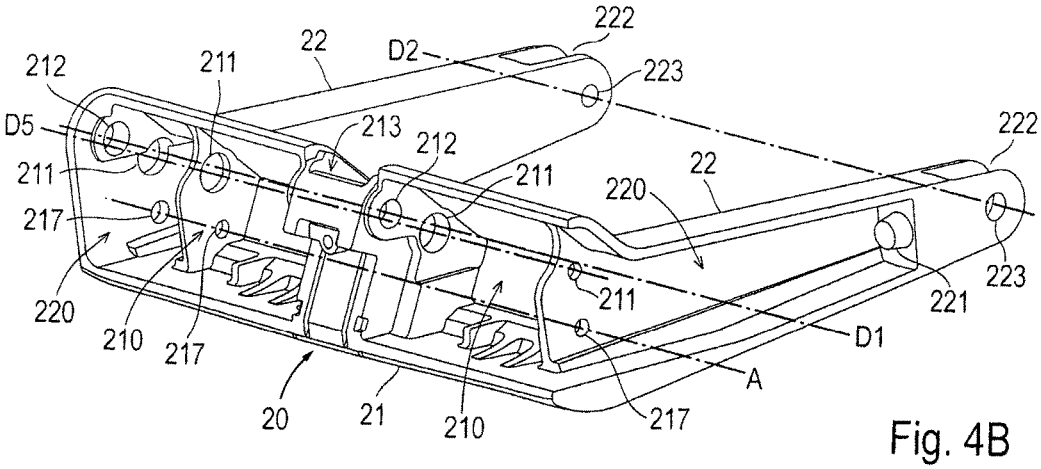
Figure 4C:
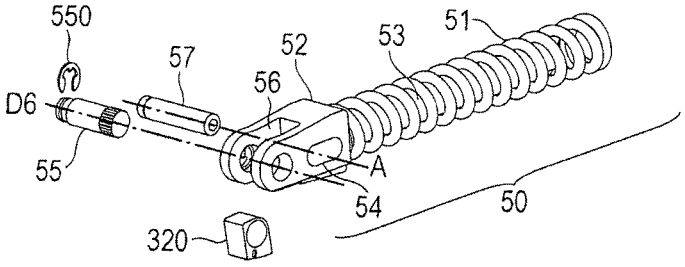
Figure 4D:
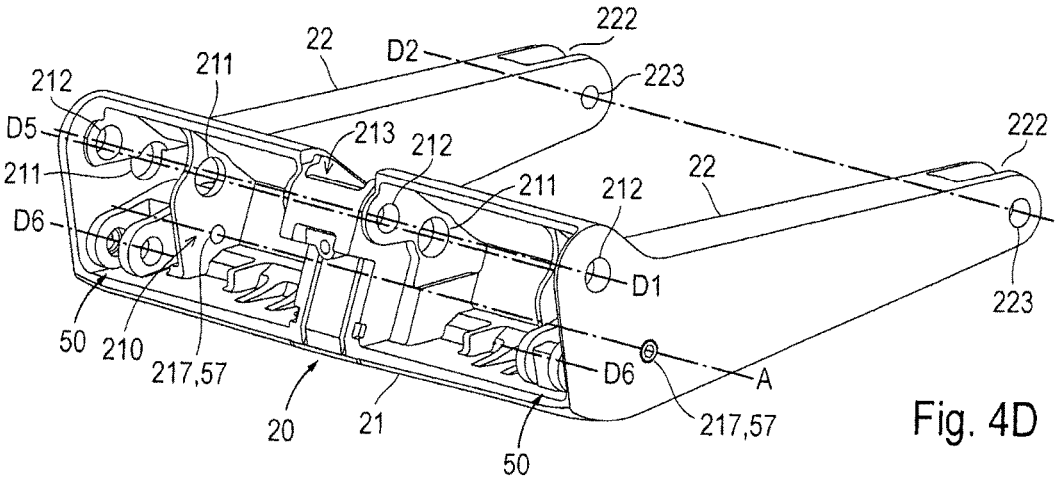
Figure 4E:
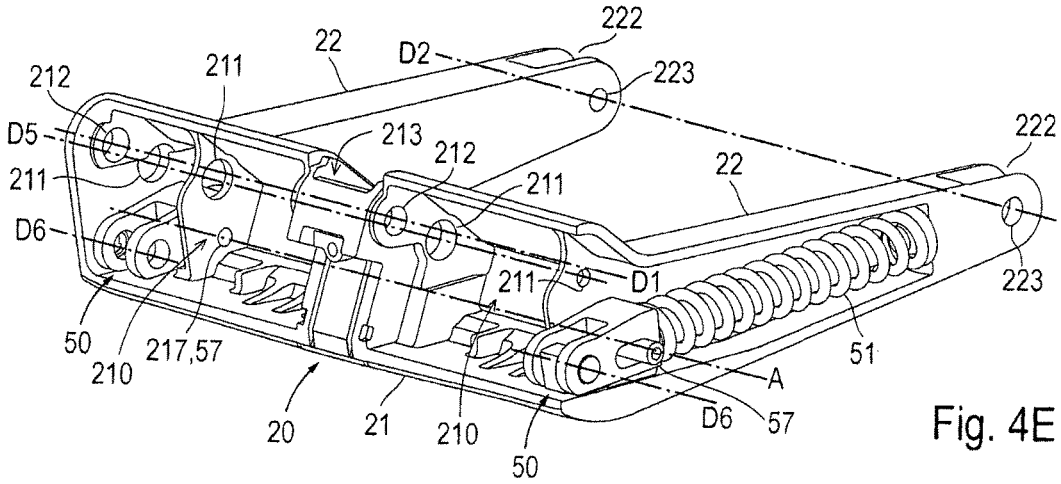
Figure 4F:
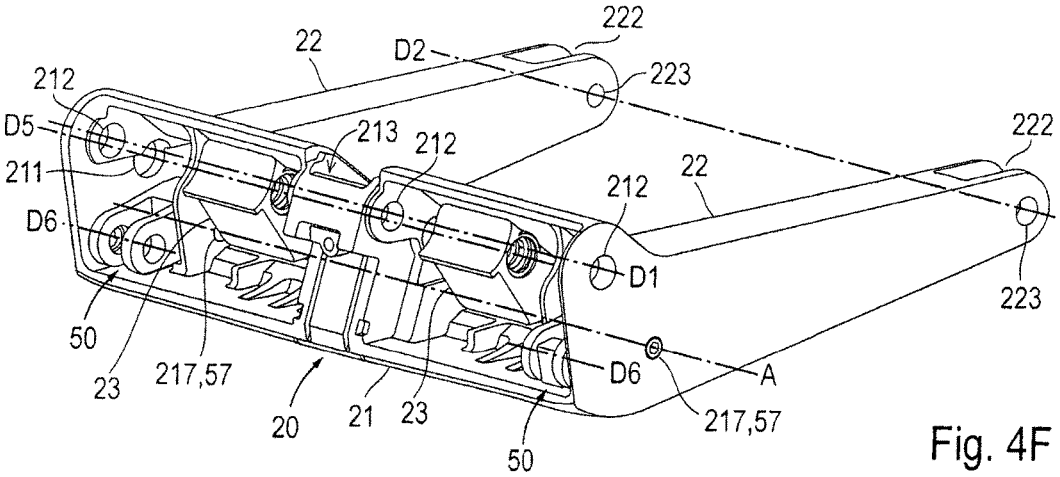
Figure 4G:
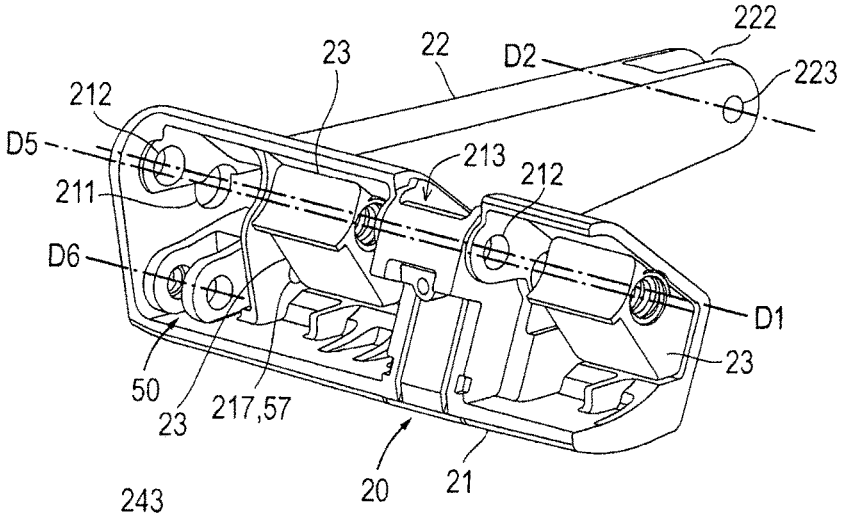
Figure 4H:
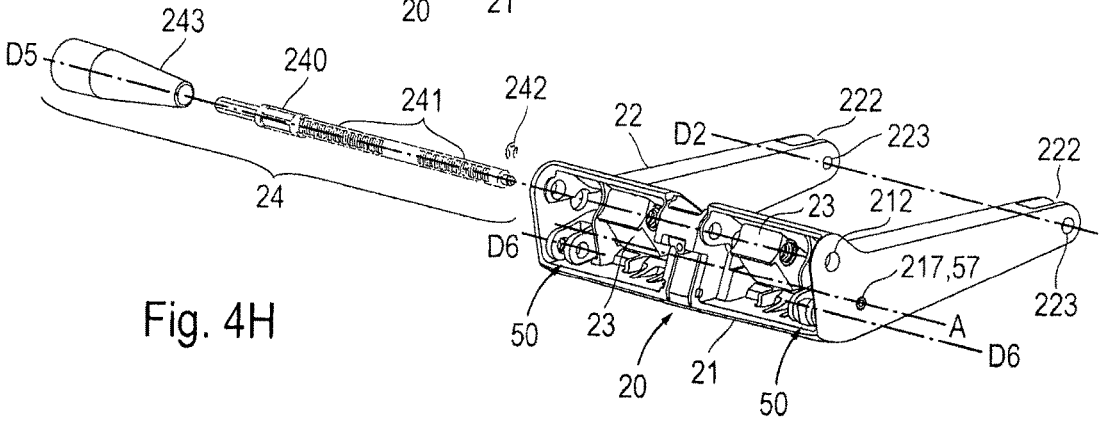
Figure 4J:
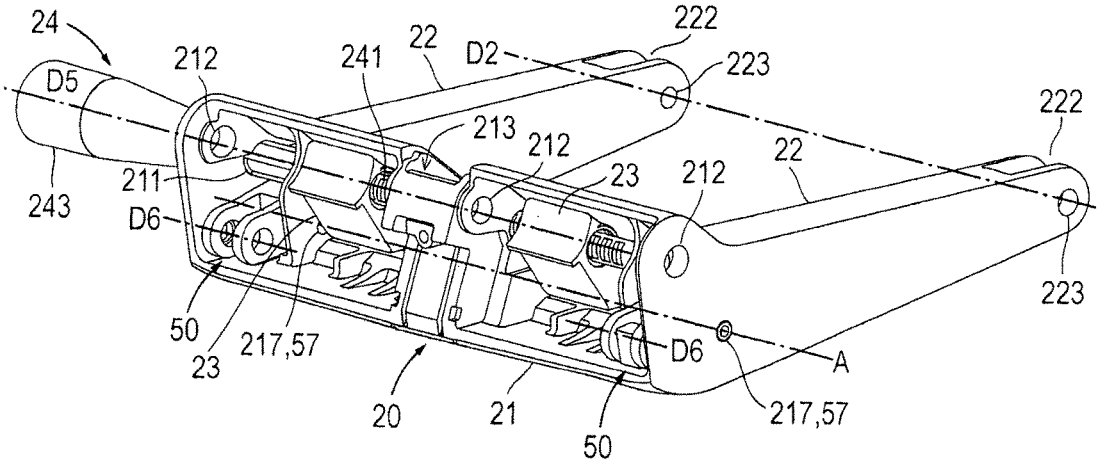
Figure 4K:
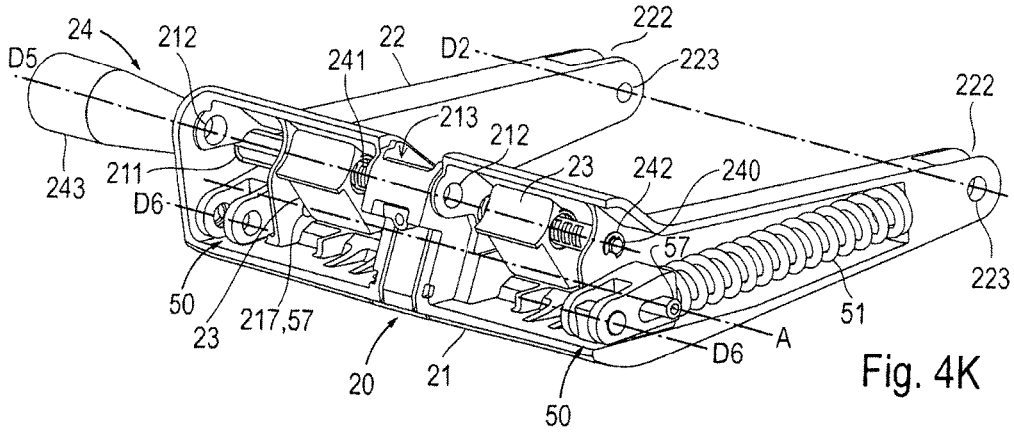
Figure 5A:
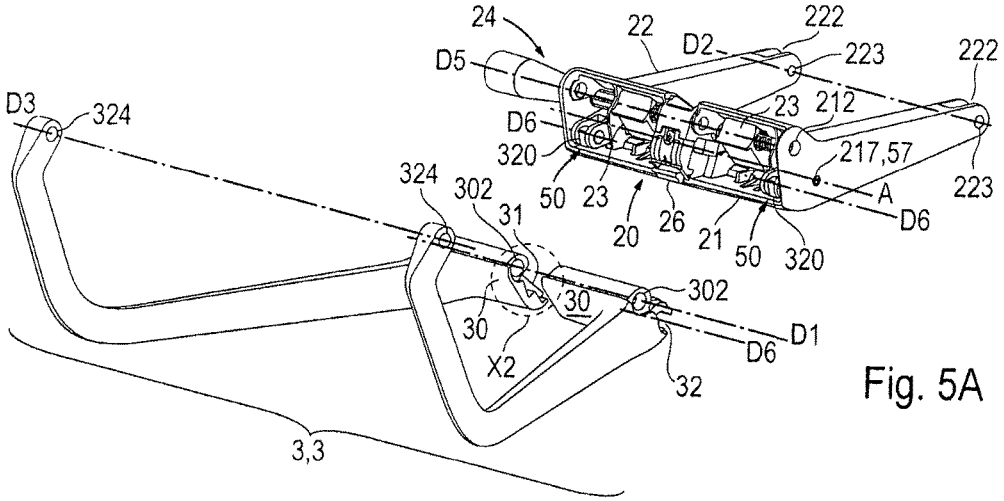
Figure 5B:
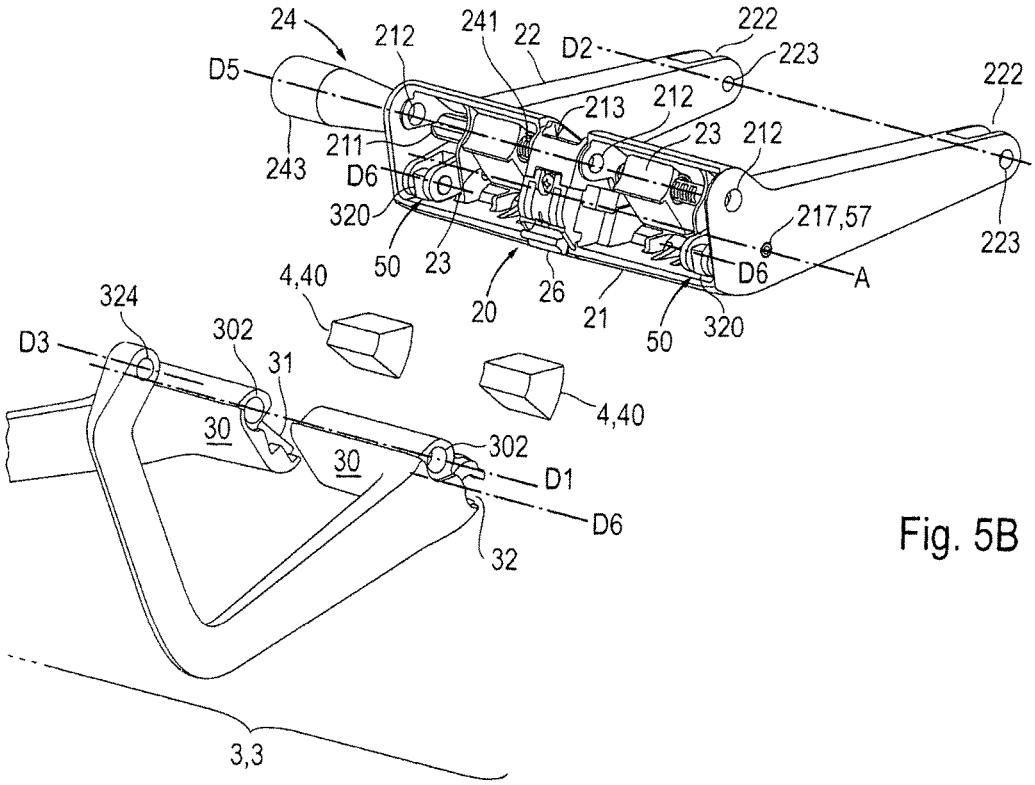
Figure 5C:
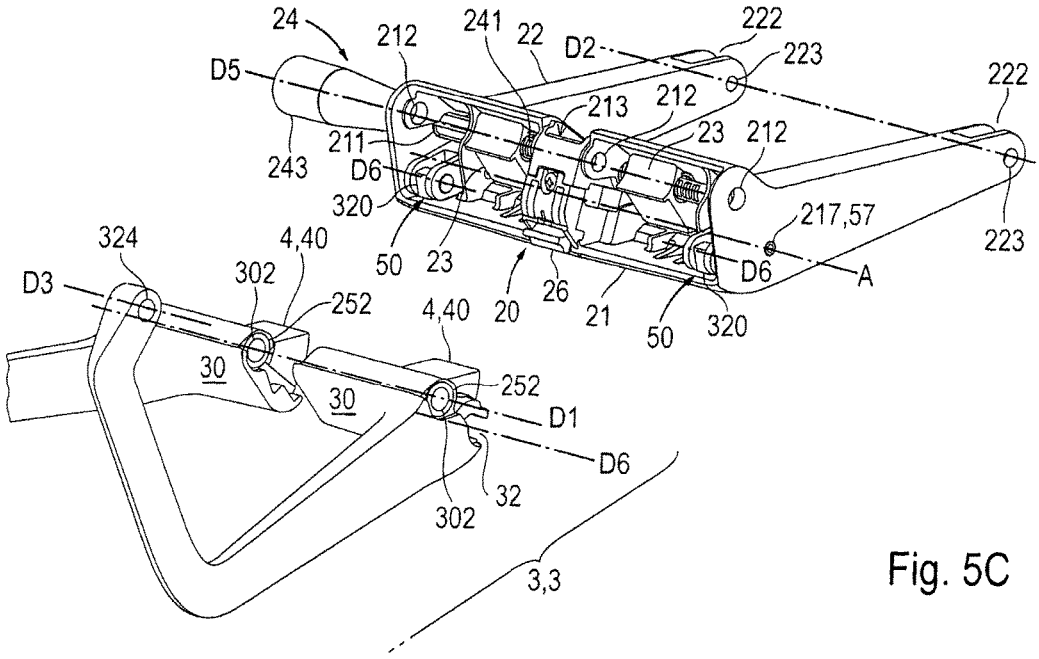
Figure 5D:
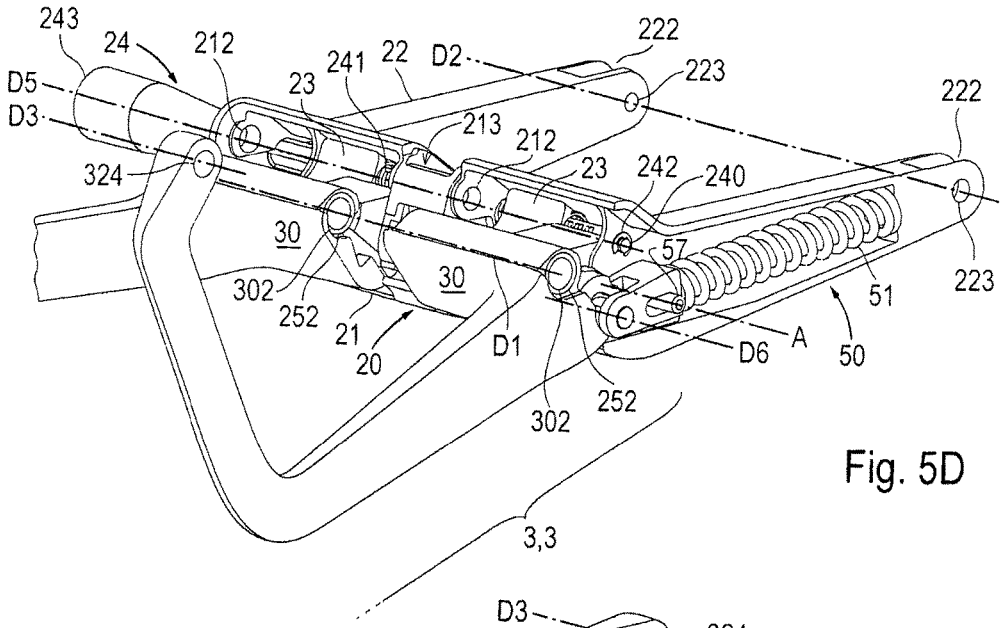
Figure 5E:
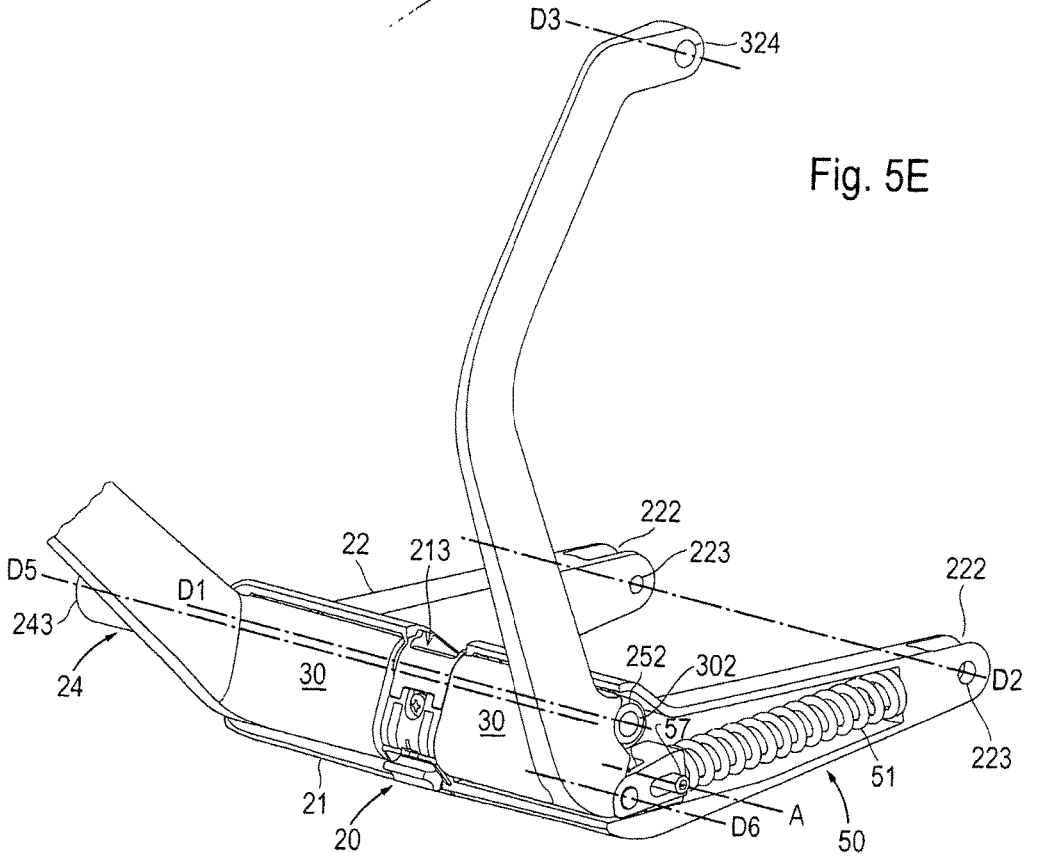
Figure 5F:
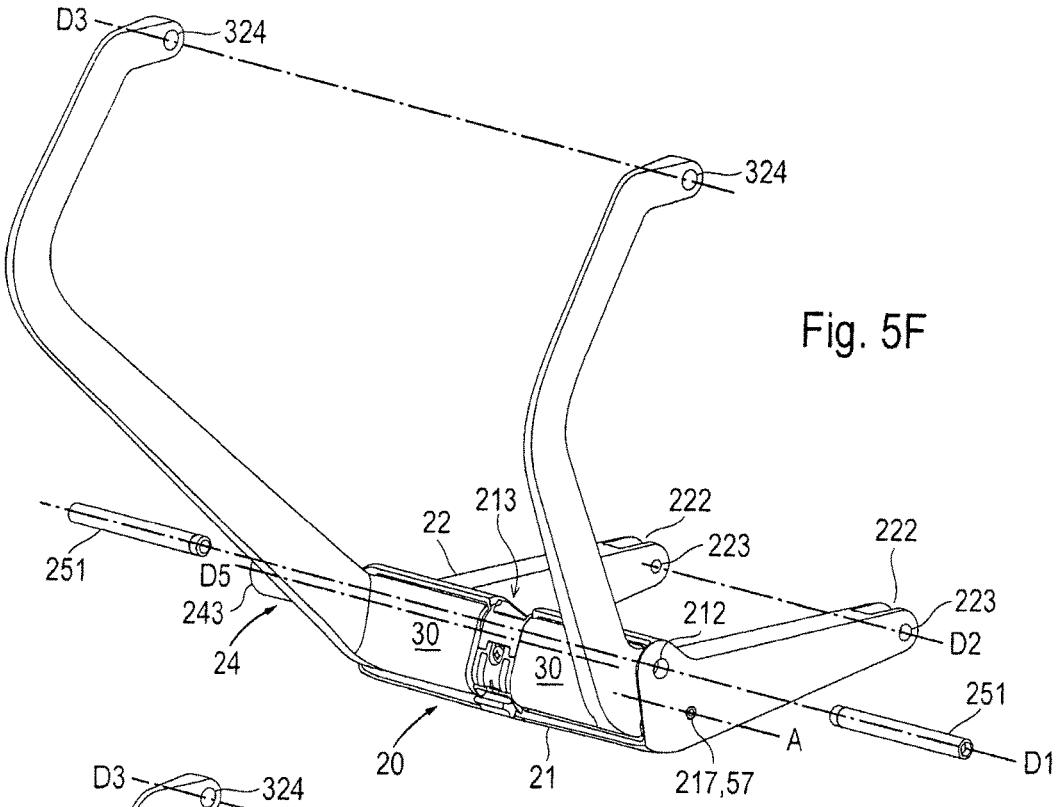
Figure 5G:
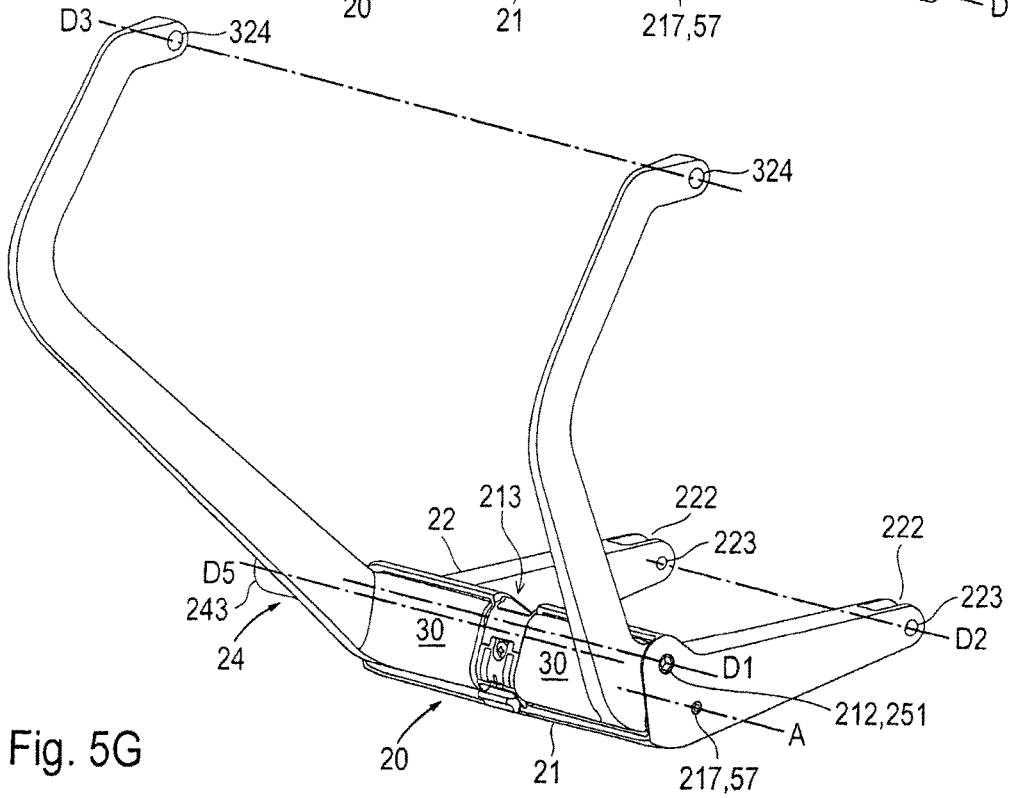
Figure 5H:
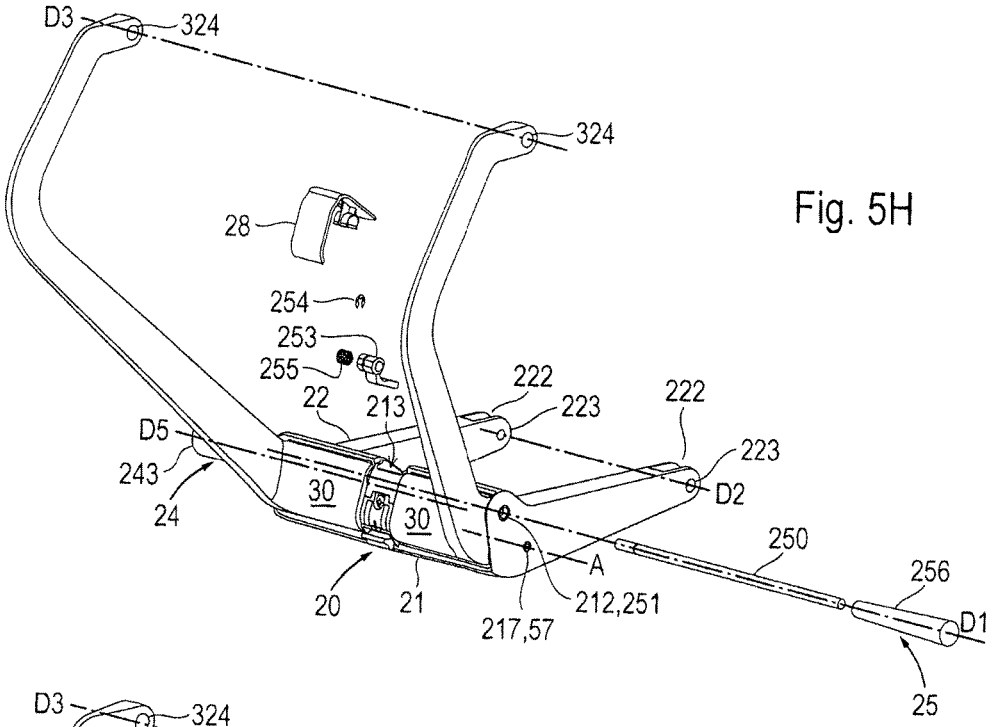
Figure 5J:
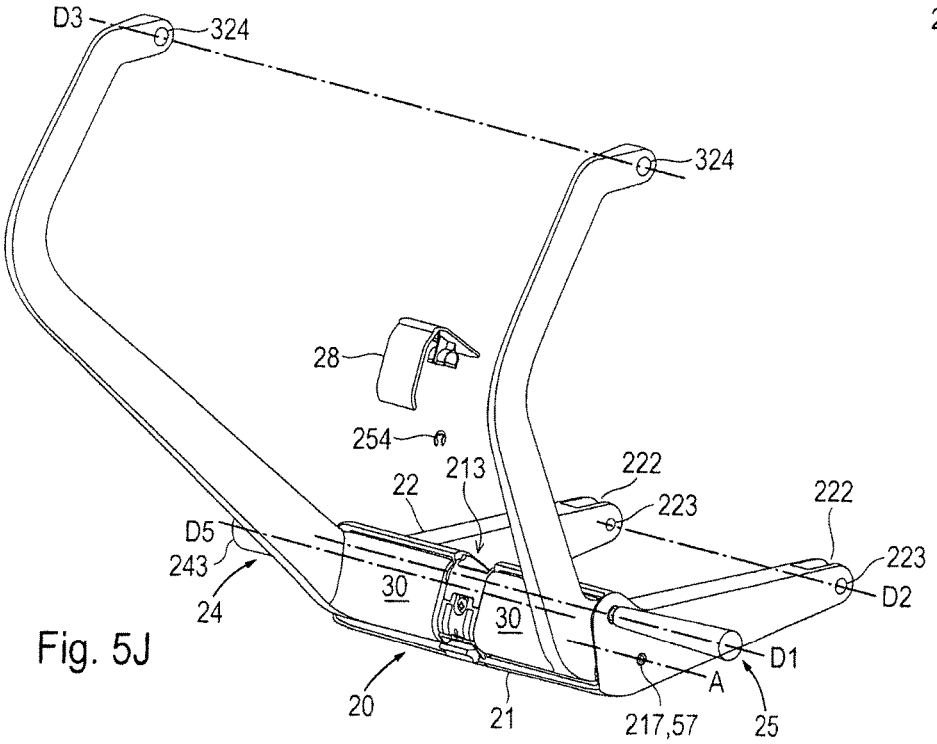
Figure 5K:
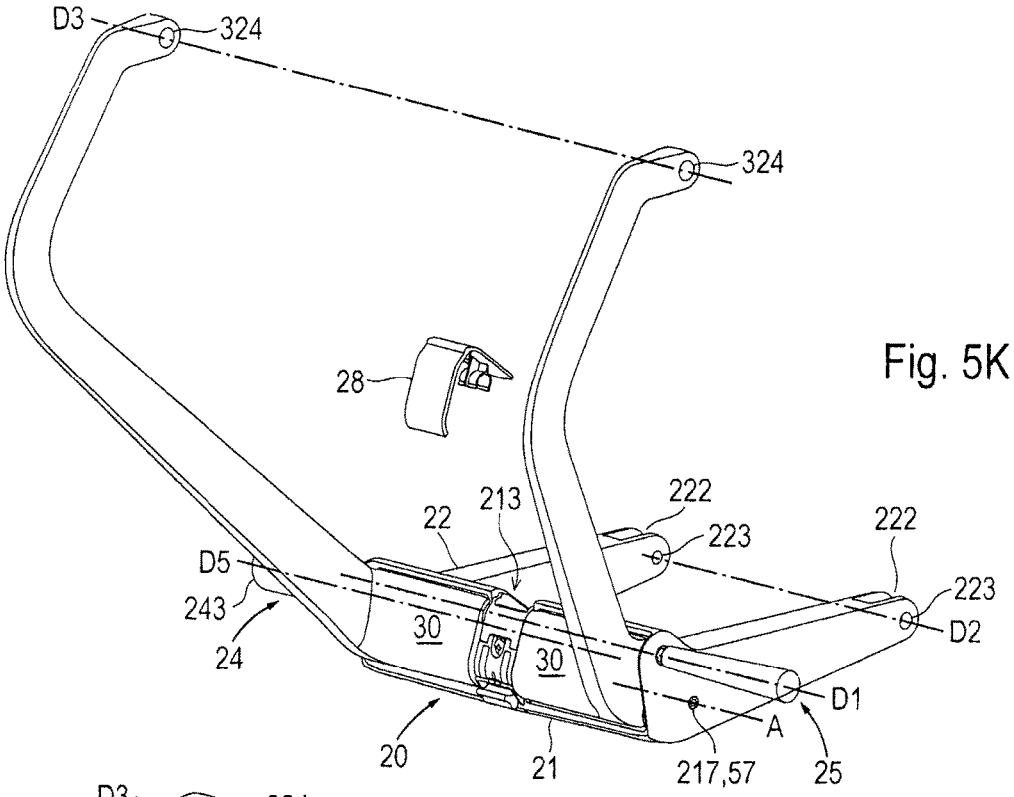
Figure 5L:
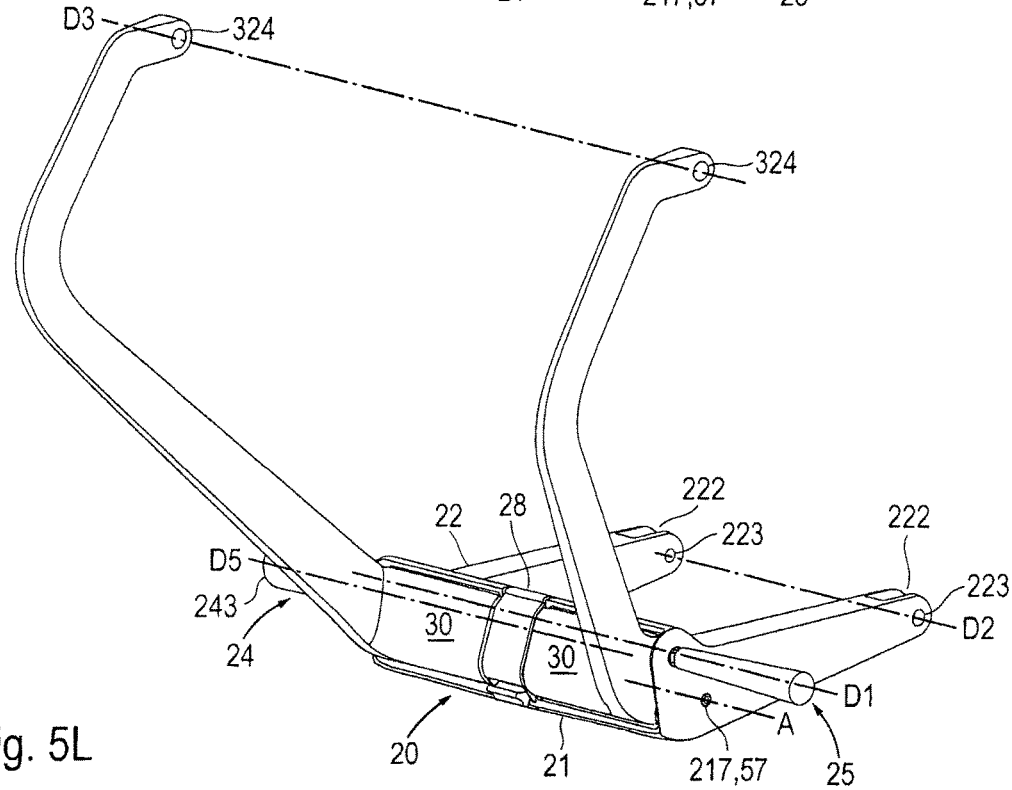
Figure 6A:
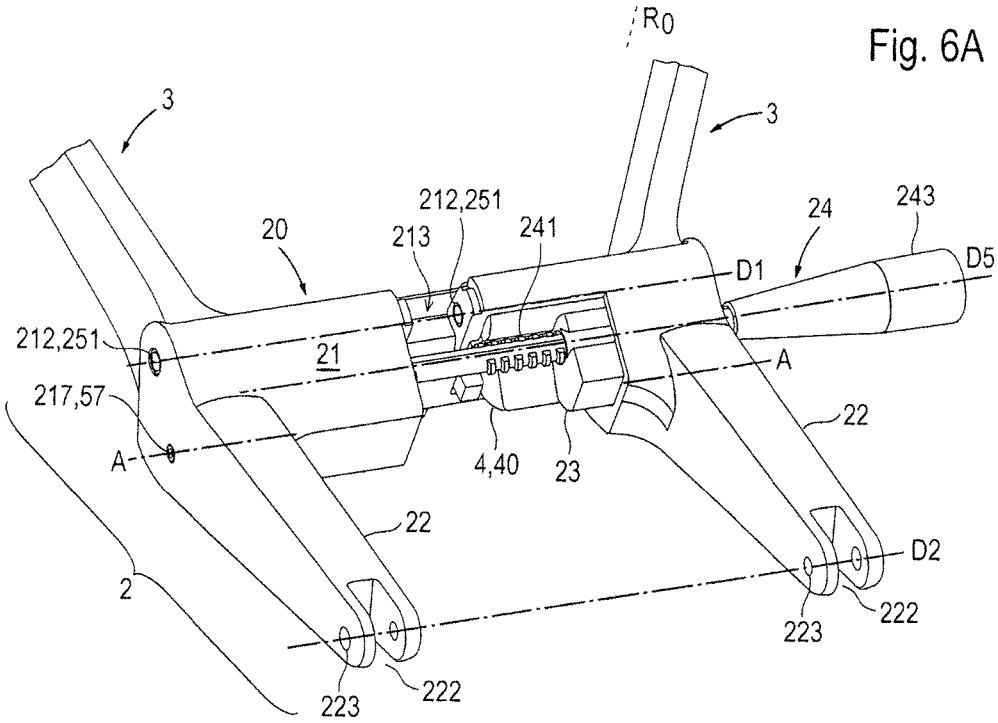
Figure 6B:
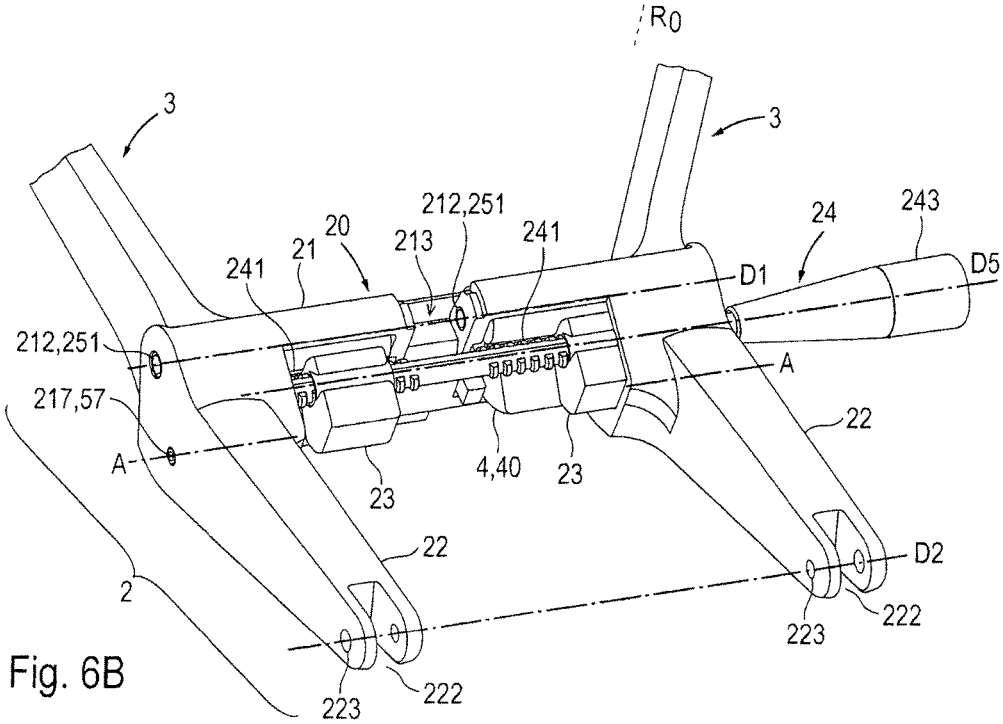
Figure 7A:
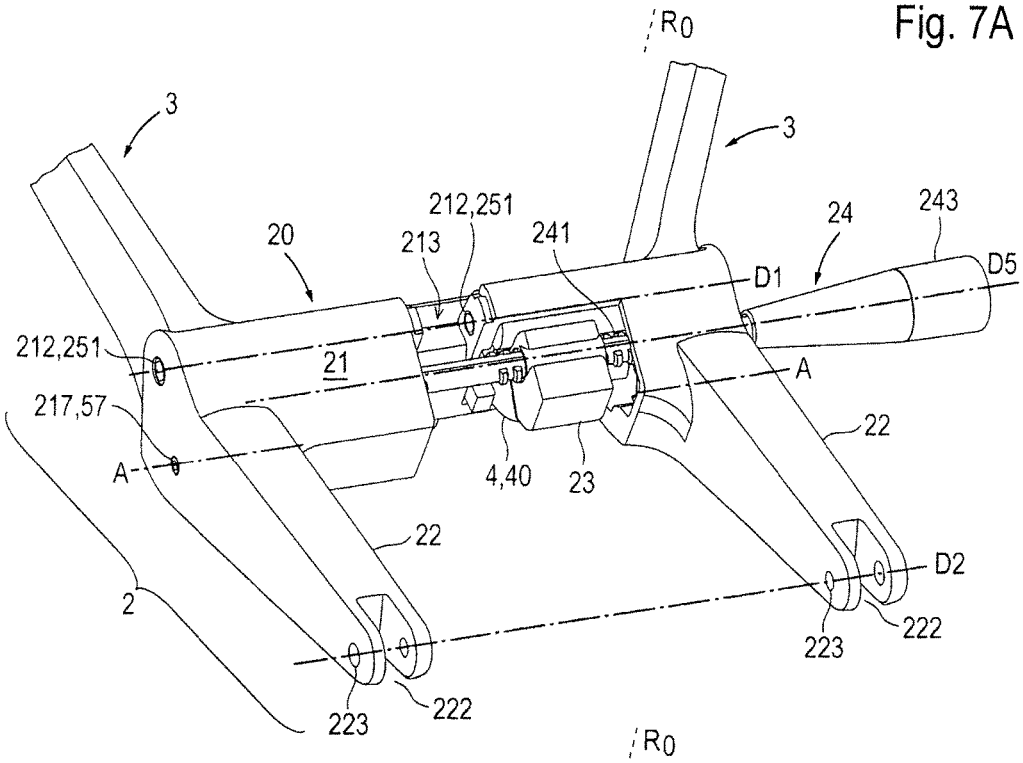
Figure 7B:
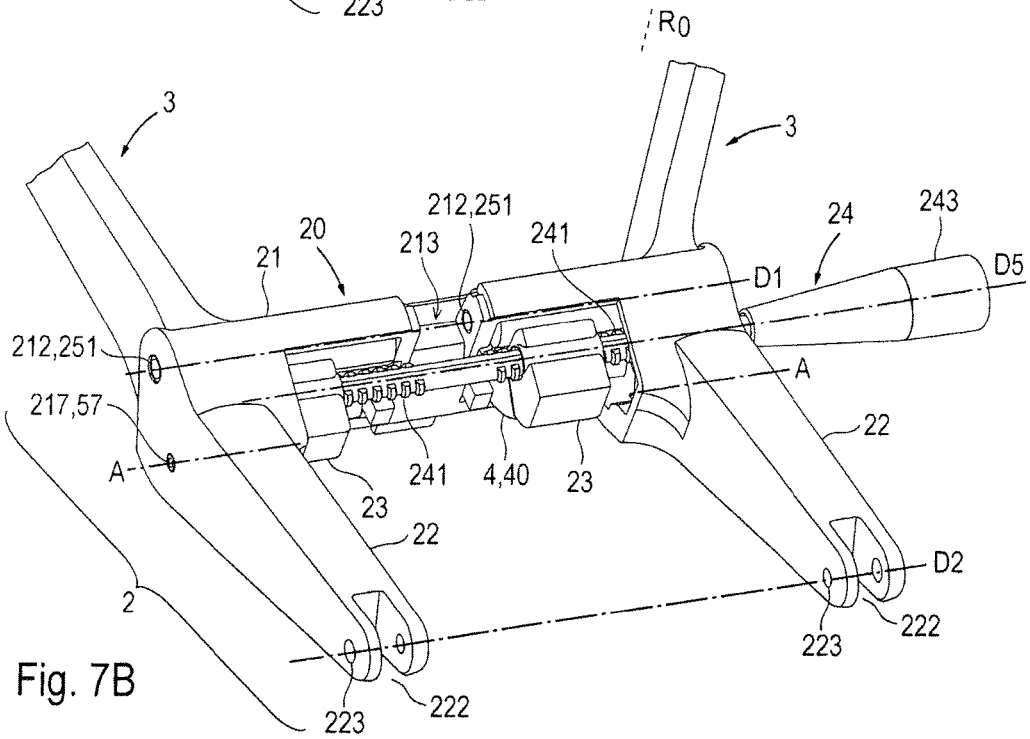
Figure 7C:
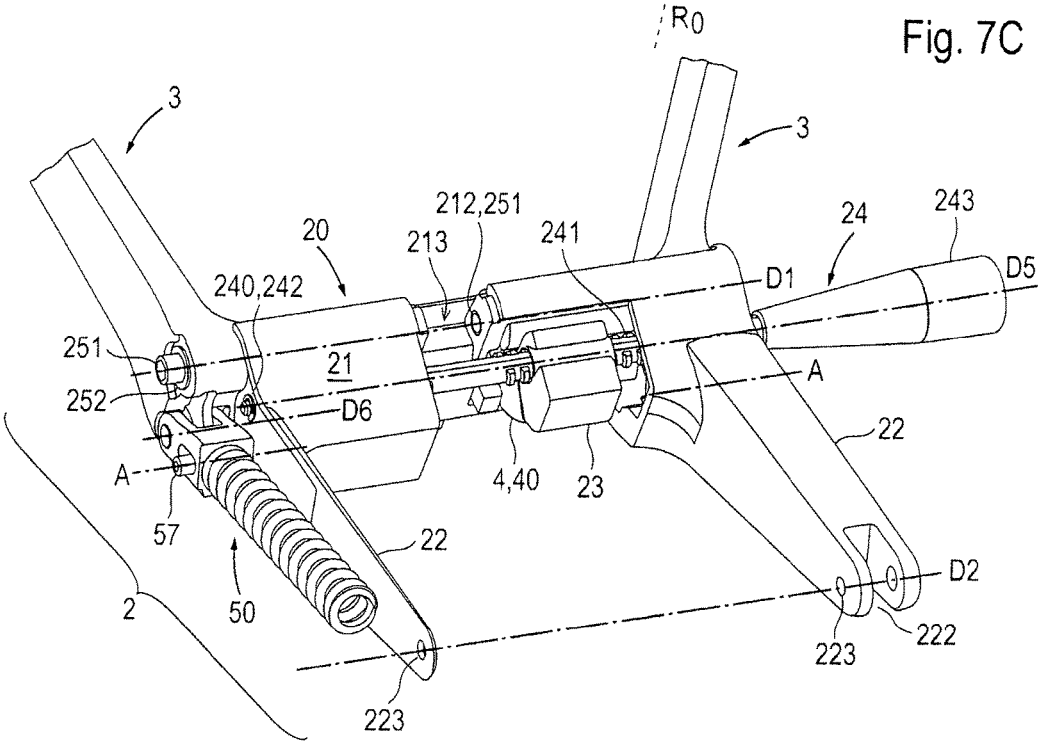
Figure 8:
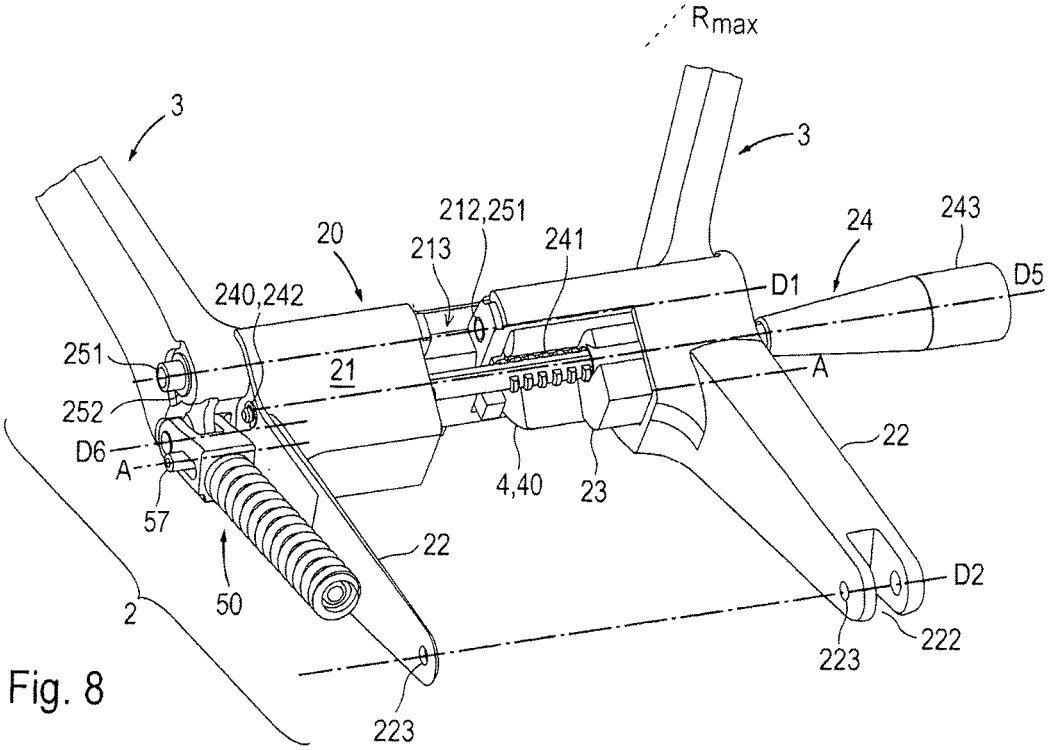

In the drawings:

FIG. 1A—shows a perspective front view of a chair according to the invention;

FIG. 1B—shows a different perspective front view of the chair according to FIG. 1A, without the cover;

FIG. 1C—shows a perspective rear view of the construction according to FIG. 1B;

FIG. 1D—shows a perspective view from beneath of the construction according to FIG. 1B;

FIG. 1E—shows a side view of the construction according to FIG. 1B with the support in the zero position of back and seat inclination;

FIG. 1F—shows a side view of the construction according to FIG. 1B with the support in the maximum back and seat inclination;

FIG. 2A—shows a partial perspective exploded view, from the front at the top, of the construction according to FIG. 1B;

FIG. 2B—shows a partial perspective exploded view, from the rear at the bottom, of the construction according to FIG. 2A;

FIG. 3A—shows a perspective exploded view of the base, the spring units and the backrest bows from FIG. 2A;

FIG. 3B—shows a different perspective exploded view of the construction according to FIG. 3A;

FIG. 3C—shows the enlarged detail X1 from FIG. 3A;

FIG. 3D—shows an enlarged perspective view of the slide from FIG. 3A;

FIG. 3E—shows an enlarged perspective view of the covering from FIG. 3A;

FIG. 4A—shows an enlarged perspective rear view of the housing of the base from FIG. 3A;

FIG. 4B—shows a partial perspective sectional view of the housing according to FIG. 4A;

FIG. 4C—shows an enlarged perspective view of a partially assembled assembly of the second spring unit from FIG. 3A;

FIGS. 4D to 5L show: perspective views of the phased assembly of base, spring units and backrest bows;

FIG. 4D—shows the first phase: the housing according to FIG. 4A, with the second spring unit inserted;

FIG. 4E—shows a partial perspective sectional view of the construction according to FIG. 4D;

FIG. 4F—shows the second phase: the construction according to FIG. 4E, supplemented by inserted pressure pieces;

FIG. 4G—shows a partial perspective sectional view of the construction according to FIG. 4F;

FIG. 4H—shows the third phase: the construction according to FIG. 4F, with the pre-adjustment mechanism close to the housing;

FIG. 4J—shows the construction according to FIG. 4H, with the pre-adjustment mechanism inserted in the housing;

FIG. 4K—shows a partial perspective sectional view of the construction according to FIG. 4J;

FIG. 5A—shows the fourth phase: the construction according to FIG. 4K, with the slide positioned on the housing and with the covering and also with the backrest bows close to the housing;

FIG. 5B—shows the fifth phase: the construction according to FIG. 5A, with the first spring unit fitted between the housing and backrest bows;

FIG. 5C—shows the sixth phase: the construction according to FIG. 5B, with the first spring unit fixed on the backrest bows and bushings inserted into the lower axial holes;

FIG. 5D—shows the seventh phase: a partial perspective sectional view of the construction according to FIG. 5C, with the lowered backrest bows aligned with the axis of rotation D1 and docked on the second'spring unit on the axis of rotation D6;

FIG. 5E—shows a partial perspective sectional view of the construction according to FIG. 5D, with the backrest bows set upright;

FIG. 5F—shows the eighth phase: the construction according to FIG. 5E, with sleeves which are aligned with the axis of rotation D1 and are close to the housing;

FIG. 5G—shows the construction according to FIG. 5F, with the sleeves inserted;

FIG. 5H—shows the ninth phase: the construction according to FIG. 5G, with a height-adjustment mechanism aligned with the axis of rotation D1 and close to the housing, and release mechanism and cap;

FIG. 5J—shows the construction according to FIG. 5H, with the height-adjustment mechanism inserted on the axis of rotation D1 and the release mechanism fitted;

FIG. 5K—shows the construction according to FIG. 5J, with a securing means inserted on the axis of rotation D1;

FIG. 5L—shows the tenth phase: the construction according to FIG. 5K, with a cap plugged thereon;

FIGS. 6A to 8 show: schematic illustrations, in a partial perspective sectional view, of settings of the pretension at the first spring unit, in the zero position of back and seat inclination and maximum back and seat inclination;

FIG. 6A—shows the construction according to FIG. 5K, in the zero position of back and seat inclination and with minimum pretension at the first spring unit;

FIG. 6B—shows the construction according to FIG. 6A, in an expanded sectional view of the first spring unit;

FIG. 7A—shows the construction according to FIG. 5K, in a zero position of back and seat inclination and with maximum pretension at the first spring unit;

FIG. 7B—shows the construction according to FIG. 7A, in an expanded sectional view of the first spring unit;

FIG. 7C—shows the construction according to FIG. 7A, in an expanded sectional view of the second spring unit;

FIG. 8—shows the construction according to FIG. 5K, at a maximum back and seat inclination and with minimum pretension at the first spring unit, in an expanded sectional view of the first spring unit;

FIGS. 9A to 9D show: schematic illustrations of an unblocked and blocked zero position of back and seat inclination;

FIG. 9A—shows the construction according to FIG. 5L, slide in unblocked position;

FIG. 9B—shows the construction according to FIG. 5L, slide in blocked position;

FIG. 9C—shows the enlarged detail X2 from FIG. 9A; and

FIG. 9D—shows the enlarged detail X3 from FIG. 9B.

EXEMPLARY EMBODIMENT

The detailed description of an exemplary embodiment of the chair according to the invention will be given below with reference to the attached drawings.

The following statement applies to the entirety of the rest of the description. If, in order to avoid ambiguity in the drawings, a figure contains designations which are not explained in the directly associated text of the description, reference is made to the point at which they are mentioned in the previous descriptions of the figures. For reasons of clarity, components are generally not designated again in subsequent figures, provided that it is clearly identifiable from the drawings that they are "recurring" components.

FIGS. 1A to 1F

The chair consists of the substructure 1, which is placed on the floor, with the fork-shaped base 2 resting on said substructure. Two backrest bows 3 which are spaced apart from each other and to which a respective support 6 and a respective armrest 7 are fastened extend upward from the base 2. The substructure 1 has a star-shaped stand 10 from which a vertical upright tube 11 extends centrally, said upright tube 11 serving to receive a height-adjustment pneumatic spring 12. The stand 10 is provided with a plurality of floor-going elements 14, for example rollers. A stationary first axis of rotation D1 on which the backrest bows 3 are articulated and on which a height-adjustment mechanism 25 is guided in an axially movable manner runs through the rear region of the base 2. The pneumatic spring 12 can be actuated by the height-adjustment mechanism 25 and therefore the height of the seat can be varied in accordance with a user's needs. In addition, the pneumatic spring 12 permits the seat to rotate about a vertical axis V, as is customary for comfortable office chairs.

A stationary second axis of rotation D2 on which the support 6, which is provided as a single part or a multi-part form, is articulated on the front side runs through the front region of the base 2 and parallel to the axis of rotation D1. Furthermore, the support 6 is connected on the rear side to the two backrest bows 3 on the movable third axis of rotation D3. This third axis of rotation D3 is pivotable about the first axis of rotation D1 and extends through the back region 62 of the support 6. The rotatable pre-adjustment mechanism 24, with which the force required for deflecting back and seat inclination from the zero position $R_0$,$S_0$ can be varied, is arranged on the stationary fifth axis of rotation D5. A stationary axis A runs parallel to and at a distance from the axes of rotation D1,D2,D3 and serves for receiving the second spring unit 5 described later on (see FIG. 3A).

The chair is preferably provided with two armrests 7 which are articulated on one side in the third axis of rotation D3 and on the other side in a movable fourth axis of rotation D4 which extends through the seat region 61 of the support 6 and is likewise pivotable about the first axis of rotation D1. The individual, virtually angular armrest 7 is structured in the support region 71, which protrudes upward from the fourth axis of rotation D4, and in the basically horizontal bearing region 72 which leads onto the third axis of rotation D3. An arcuate transition 78 lies between the support region 71 and the bearing region 72.

The support 6 is substantially composed of two strip-shaped struts 60 which are spaced apart parallel to each other and are basically bent in a L-shaped manner and between which a first cross strut 63, a second cross strut 67 and a back bow 64, which connect the struts 60 to each other, extend. The entire support 6 can be provided as a single part, or the cross struts 63,67 and the back bow 64 are fitted between the struts 60 as separate parts. The first cross strut 63 runs at the front, and the second cross strut 67 runs at the rear in the seat region 61 while the back bow 64 extends over the back region 62. The transition between seat region 61 and back region 62 is produced as a region of elasticity 68. Each strut 60, on the outwardly facing side thereof, has a groove 66 in which a cover 69 which stretches over the entire support 6 on the front side is fixed, and therefore a virtually horizontal seat surface and a virtually vertical backrest are produced for the user.

The zero position of back and seat inclination (see FIG. 1E) is characterized as follows:

- minimum back inclination $R_0$, i.e. the back region 62 of the support 6 is approximately vertical;
- minimum seat inclination $S_0$, i.e. the seat region 61 of the support 6 is approximately horizontal;
- the regions of elasticity 68 of the support 6 are not bent up; and
- the armrests 7 are not bent up.

The maximum back and seat inclination (see FIG. 1F) which behave synchronously with respect to each other is characterized as follows:

- maximum back inclination $R_{max}$, i.e. the back region 62 of the support 6 slopes rearward;
- maximum seat inclination $S_{max}$, i.e. the seat region 61 of the support 6 slopes rearward and downward;
- the regions of elasticity 68 of the support 6 are bent up to the maximum; and
- the armrests 7 are bent up to the maximum, for example at the support regions 71 and/or the transitions 78, depending in each case on the configuration of the armrests 7.

FIGS. 2A and 2B

The first cross strut 63 has connecting members at the free ends thereof in order to connect the latter to the receptacle present on the respective strut 60. Two front connecting members 630 which are spaced apart from each other emerge from the first cross strut 63 and in each case have a front axial hole 633 through which the second axis of rotation D2 runs. Adjacent to the region of elasticity 68, the second cross strut 67 is present between the struts 60, adjoining the seat region 61. The free ends of the second cross strut 67 have connecting members which serve for the connection to the receptacle on the associated strut 60.

A central connecting member 610 which has a fifth axial hole 615 is present on each strut 60 between second cross strut 67 and first cross strut 63. Each strut 60 has an upper connecting member 620 with a fourth axial hole 624 between the region of elasticity 68 and adjoining the back region 62. The back bow 64 extends between the struts 60 close to the lower end of the back region 62. The back bow 64 has a respective connector 640 on both sides at the outer ends, said connectors 640 being provided in a complementary manner to the upper connecting member 620 located on the respective strut 60. The two cross struts 63,67 and the back bow 64 are fixed on the respective strut 60, for example, by means of screws.

At the free end of the bearing region 72, the individual armrest 7 has an upper axial pin 74 which extends on the third axis of rotation D3. At the free end of the support region 71 there is a lower axial pin 75 which is directed toward the fourth axis of rotation D4. The armrests 7 are offset somewhat outward in relation to the support 6, wherein the third axis of rotation D3 runs in an aligned manner through the upper axial pins 74 of the armrests 7 and the fourth axial holes 624 of the upper connecting members 620 of the struts 60. The fourth axis of rotation D4 runs in an aligned manner through the lower axial pins 75 of the armrests 7 and the fifth axial holes 615 of the central connecting members 610 of the struts 60. Two axial pins 224 lie on the second axis of rotation D2 and are intended for insertion into the base 2. By means of the axial pins 224, the support 6 is pivotably connected at the front connecting members 630 thereof to the base 2 level with the second axis of rotation D2. The substructure 1 is shown here removed from the base 2.

On the support 6, outside the regions of elasticity 68, the seat regions 61 and the back regions 62 are preferably also elastic. The first and second cross struts 63,67 and the back bow 64 can also be elastic. Furthermore, the support regions 71 and the bearing regions 72 can also be elastic outside the transitions 78 to the armrests 7—instead of the transitions 78 or in addition thereto. The support 6 is particularly advantageously produced as an integral injection molded plastics part and the cover 69 is produced as a single-part fabric which can be shrink-fitted onto the support 6.

FIGS. 3A to 3E

The base 2 is composed of a housing 20, the pre-adjustment mechanism 24 and the height-adjustment mechanism 25. The housing 20 has a central part 21 from which two limbs 22 which are spaced apart from each other and run parallel emerge. The first axis of rotation D1, the fifth axis of rotation D5 and the axis A extend through the central part 21. The second axis of rotation D2 runs in the vicinity of the free ends of the limbs 22, wherein a respective axial pin 224 is ready for insertion in alignment with the second axis of rotation D2.

A height-adjustable slide 26 for blocking the zero position of back and seat inclination $R_0$,$S_0$ and for releasing same for the deflection into the maximum back and seat inclination $R_{max}$,$S_{max}$ is provided at the rear end of the central part 21. The slide 26 has a plate 260 on which two webs 261 which are spaced apart vertically parallel to each other extend, the webs engaging in complementary grooves present on the housing 20, and therefore the slide 26 is guided in the downward or upward movement. An extension arm 262 on which a cuboidal block 263 sits extends laterally in each case from the plate 260 at the upper edge. The block 263 serves for the blocking (described later) of the back and seat inclination. A strip 264 is present opposite the upper edge of the slide 26, on the lower edge thereof, in order to enable ergonomic grasping for the user. Opposite the webs 261, the plate 260 has elevations which are intended for complementary engagement in contours present on the covering 27. The slide 26 is fastened to the housing 20 using the covering 27 and a screw 270, but the downward or upward movement of the slide 26 continues to be ensured.

A cap 28 is provided for placing the third cavity 213 (see FIG. 4A) present on the central part 21. The pre-adjustment mechanism 24 lying on the fifth axis of rotation D5 consists of a spindle 240 with an external thread 241. A handle 243 can be positioned at one end of the spindle 240, wherein a securing means 242 can be pluggable onto the opposite end of the spindle 240. Two virtually rectangular pressure pieces 23 are aligned with the fifth axis of rotation D5 and are intended for complementary engagement with the external thread 241 of the spindle 240. The height-adjustment mechanism 25 lying on the first axis of rotation D1 has a rod 250 on which two sleeves 251, four bushings 252, a release mechanism 253, a securing means 254, a spring 255 and a gripping piece 256 can be positioned.

The backrest bows 3 are of mirror-symmetrical construction, and therefore only one backrest bow 3 will be described below. The backrest bow 3 has an extension 30 in which a lower axial hole 302, which is aligned with the first axis of rotation D1, sits. A shoulder 31 which is provided with a contour 310 adjoins the extension 30. The contour 310 is stepped and has a first step 311 and a second step 312 which is adjoined by the clearance 313. A cutout in the form of a bearing 32 which serves for receiving the insert 320 is present adjacent to the shoulder 31. The bearing 32 or the insert 320 sitting subsequently therein is passed through by a sixth axis of rotation D6 which lies parallel to and spaced apart from the first axis of rotation D1. The third axis of rotation D3 which extends through the upper axial hole 324 lies opposite the axes of rotation D1,D6.

The first spring unit 4 consists of two virtually trapezoidal first spring elements 40, preferably made from elastically deformable plastic, which can be fixed on the respective shoulder 31 of the corresponding backrest bow 3. The second spring unit 5 is composed of two identical assemblies 50 through which the axis A and the sixth axis of rotation D6 extend. The pin 57 which fixes the assembly 50 in the base 2 is assigned to each assembly 50 with respect to the direction of alignment of the axis A. A bolt 55 associated with each assembly 50 is aligned with the sixth axis of rotation D6 and, in the mounted state, protrudes through the insert 320 sitting in the bearing 32.

FIGS. 4A to 4C Adjacent to each limb 22, the central part 21 of the housing 20 has in each case a first cavity 210 which serves to receive the corresponding pressure piece 23. A second cavity 220 for the mounting of the assembly 50 is present in the longitudinal extent of each limb 22. The third cavity 213 which serves for the insertion of the release mechanism 253, the securing means 254 and the spring 255 of the height-adjustment mechanism 25 is provided on the upper side of the central part 21. The height-adjustment pneumatic spring 12 is partially insertable and fixable from the lower side of the central part 21 into a receptacle which is virtually aligned with the third cavity 213.

The housing 20 has a total of five first axial holes 211 which are all aligned with the fifth axis of rotation D5. In the outer side wall of the housing 20, the first axial hole 211 is provided only on the side of the pre-adjustment mechanism 24. A further first axial hole 211 is located adjacent to said first axial hole 211 in the partition between first cavity 210 and second cavity 220. A further first axial hole 211 is provided in each case in the corresponding wall between the two first cavities 210 and third cavity 213. The still remaining first axial hole 211 is positioned in the partition between first cavity 210 and second cavity 220. The housing 20 furthermore has a total of four second axial holes 212 which are all aligned with the first axis of rotation D1. A second axial hole 212 is present in each case in the two outer side walls of the housing 20. A further second axial hole 212 is located in each case adjacent to said second axial hole 212 in the corresponding wall between the two first cavities 210 and third cavity 213. Apart from the first axial holes 211 and second axial holes 212, the housing 20 has a total of four holes 217 which are all aligned with the axis A. The two outer side walls of the housing 20 are provided with a hole 217. A further hole 217 in each case sits adjacent to said hole 217 in the partitions between first cavity 210 and second cavity 220. A front fixing member 221 which rises from the base surface in the opposite direction to the front fork 222 is located within the second cavity 220. The free end of the individual limb 22 has the front fork 222 with a third axial hole 223 therein. The second axis of rotation D2 extends in an aligned manner through the two third axial holes 223.

The assemblies 50 belonging to the second spring unit 5 are of identical construction, and therefore only one of said assemblies is described below. A second spring element 51 in the form of a spiral spring is connected to an end piece 52 with the aid of a rear fixing member 53. The end piece 52 has an elongated hole 54 through which the pin 57 protrudes later. Opposite the rear fixing member 53, the end piece 52 has a rear fork 56, in which the insert 320 is located. In the mounted state of the assembly 50, the bolt 55 protrudes through the two bores in the rear fork 56 and the insert 320 and is secured in the axial direction along the sixth axis of rotation D6 thereof by the securing means 550. By contrast, the axis A passes in an aligned manner through the pin 57 and the elongated hole 54 in the end piece 52.

FIGS. 4D and 4E (first construction phase)

The second spring unit 5 is inserted into the base 2 and is connected thereto. The insert 320 is first of all placed here on the corresponding assembly 50 in the rear fork 56 and secured in the axial direction along the sixth axis of rotation D6 by means of the bolt 55 and the securing means 550. The respective assembly 50 with the second spring element 51 in front is then pushed into the corresponding second cavity 220 on the limb 22 until the free end of the second spring element 51 is plugged on the front fixing member 221. The pin 57 is plugged in the elongated hole 54 on the axis A and rests in the holes 217. This operation takes place in the same manner with the other assembly 50. On one side, the pin 57 has a step which lies on the partition adjoining the second cavity 220 in each case. The diameter-reduced continuation of the pin 57 sits in the hole 217, which is complementary thereto, in the partition. When the pin 57 is inserted, the corresponding assembly 50 rises slightly.

FIGS. 4F and 4G (second construction phase)

The corresponding pressure piece 23 is inserted into each first cavity 210. The individual pressure piece 23 bears here, by means of a bulge present along the internal thread, against the upper side of the inner surface of the first cavity 210, as a result of which the friction during the adjustment operation (described later) is minimized and therefore the adjustment of the pressure pieces 23 runs smoothly. This position of the pressure pieces 23 has to be correspondingly aligned and fixed until the pre-adjustment mechanism 24—shown in the next construction phase—protrudes through the housing 20.

FIGS. 4H to 4K (third construction phase)

The pre-adjustment mechanism 24 belonging to the base 2 is plugged within the housing 20 and protrudes by means of the spindle 240 thereof through the five first axial holes 211 and the two pressure pieces 23. The two pressure pieces 23 here are in complementary engagement with the corresponding external threads 241 on the spindle 240. If the spindle 240 protrudes through all five first axial holes 211 and is in the correct end position, said spindle is provided with the securing means 242 which is positioned in the second cavity 220 adjacent to the first axial hole 211. The securing means 242 sits here in a circumferential groove present on the shaft 240. The grip 243 can be fixed on the spindle 240, for example by means of latching or adhesive bonding or a thread.

FIG. 5A (fourth construction phase)

First of all, the slide 26 and the associated covering 27 are attached to the rear edge of the housing 20, virtually in the direction of alignment with the third cavity 213. The covering 27 is fixed here by the screw 270, but permits a downward or upward movement for the slide 26 for the blocking or release (described later) of the synchronous adjustment of back and seat inclination. The two backrest bows 3 are close to the base 2, wherein the bearing 32 on the extension 30 of the backrest bow 3 is oriented toward the assembly 50 on the respective insert 320.

FIG. 5B (fifth construction phase)

The first spring unit 4 with the first spring element 40 is introduced between housing 20 and the individual backrest bow 3.

FIG. 5C (sixth construction phase)

The first spring elements 40 are fixed, for example adhesively bonded, on the shoulders 31 and a respective pair of bushings 252 is inserted into the associated lower axial hole 302 in the extension 30 of the backrest bow 3.

FIGS. 5D and 5E (seventh construction phase)

The individual backrest bow 3 is docked in a lowered position onto the corresponding assembly 50 of the second spring unit 5 (see FIG. 5D). The bearing 32 on the extension 30 partially engages here around the insert 320 on the assembly 50, and the first spring element 40 lies spaced apart opposite the first cavity 210. The two pressure pieces 23 have to be positioned via the pre-adjustment mechanism 24 in such a manner that said pressure pieces permit the alignment, described in the following step, of the backrest bows 3. When the backrest bow 3 is aligned, the bearing 32 located on the extension 30 completely engages around the insert 320 located on the assembly 50, and the first spring element 40 lies entirely in the first cavity 210 (see FIG. 5E).

FIGS. 5F and 5G (eighth construction phase)

One sleeve 251 in each case is brought close to the second axial hole 212 from each side of a limb 22 of the housing 20 and, in the process, is aligned with the first axis of rotation D1. The sleeves 251 are inserted into the second axial holes 212. The individual sleeve 251 protrudes here through the second axial hole 212 which is located in the outer wall of the limb 22, through the bushings 252 inserted in the lower axial hole 302, through the axial hole 212 between first cavity 210 and third cavity 213, but does not protrude into the third cavity 213, but rather ends flush therewith. The individual backrest bow 3 is under a slight pretension in this situation, i.e. the second spring element 51 is compressed to a small extent, and therefore the backrest bow 3 remains in the upright position.

FIGS. 5H to 5K (ninth construction phase)

The height-adjustment mechanism 25 is brought close to the right limb 22 while the pre-adjustment mechanism 24 protrudes from the left limb 22. The rod 250 and the gripping piece 256 are in alignment here with the first axis of rotation D1. The release mechanism 253, the securing means 254, the spring 255 and the cap 28 are ready for fitting above the third cavity 213. The rod 250 which is guided in the sleeves 251 completely protrudes through the sleeve 251, which faces the gripping piece 256, but only protrudes partially through the other sleeve 251. On being pushed through the first sleeve 251, the front end of the rod 250 reaches the third cavity 213 and receives the release mechanism 253 and the spring 255, which are aligned with the first axis of rotation D1. In a correct end position, the front end of the rod 250 is guided in the second sleeve 251 which is located on that side of the housing 20 on which the grip 243 is positioned. The grip 256 sitting on the spindle 250 is either latched, adhesively bonded or screwed in place. Via the access through the third cavity 213, the securing means 254 is latched by a slot present on the release mechanism 253 onto a circumferential groove present on the rod 250. The securing means 254 lies within the release mechanism 253 and permits the height-adjustment mechanism 25 only to move axially in the region of effect of the spring 255 on the first axis of rotation D1. When the height-adjustment mechanism 25 is actuated, the spring 255 is compressed and therefore, after actuation, brings about a restoring force in order to push the gripping piece 256 into the original position thereof.

FIG. 5L (tenth construction phase)

Finally, the cap 28 is latched onto the release mechanism 253 and therefore closes the third cavity 213. For this purpose, the lower side of the cap 28 has a contour which is complementary with respect to the release mechanism 253.

FIGS. 6A and 6B

The chair is currently in the zero position with minimum back and seat inclination $R_0$,$S_0$. The second spring unit 5 is under the pretension set during installation, in which the pins 57 are fastened in the elongated holes 54 in the direction of the front of the chair and therefore delimit the zero position on the chair. In the present case, the minimum pretension is set at the first spring unit 4. In this connection, the two pressure pieces 23 are positioned with reference to the pre-adjustment mechanism 24 in such a manner that the least overlap with the respective first spring element 40 arises. During movement into the maximum back and seat inclination $R_{max}$,$S_{max}$, the increasing inclination of the backrest bows 3 causes the first spring elements 40, which sit on the shoulders 31 of the extensions 30, to be pressed onto the pressure pieces 23 with the least spring resistance. This adjustment is suitable for light users.

FIGS. 7A to 7C

The chair continues to be in the zero position with minimum back and seat inclination $R_0$,$S_0$. In contrast to the previous pair of FIGS. 6A and 6B, maximum pretension is now set at the first spring unit 4. By actuation of the pre-adjustment mechanism 24, the two pressure pieces 23 are now positioned with maximum overlap with respect to the first spring element 40. During movement into the maximum back and seat inclination $R_{max}$,$S_{max}$, the increasing inclination of the backrest bows 3 causes the first spring elements 40 to be pressed onto the pressure pieces 23 with maximum spring resistance. This adjustment is suitable for heavier users.

FIG. 8

The chair is in the maximum back and seat inclination $R_{max}$,$S_{max}$. The second spring unit 5 is under increased tension with the pins 57 being fastened in the elongated holes 54 in the direction of the rear side of the chair and therefore delimiting the maximum back and seat inclination $R_{max}$,$S_{max}$ on the chair. The second spring unit 5 is compressed by the bearings 32 engaging in the rear forks 56 of the respective assembly 50 on the sixth axis of rotation D6 which is pivotable about the stationary first axis of rotation D1. The minimum pretension is set at the first spring unit 4, as in the pair of FIGS. 6A and 6B, i.e. the two pressure pieces 23 are positioned with the least overlap with the respective first spring element 40. The back region 62 of the support 6 is moved to the rear and therefore also causes the first spring elements 40 to be substantially pressed against the pressure pieces 23, but with the least overlap. The previously least spring resistance has therefore been increased somewhat and contributes somewhat to the restoring force into the zero position. The armrests 7 also contribute to the pushing in against the maximum back and seat inclination $R_{max}$,$S_{max}$ and as the restoring force into the zero position, said armrests 7 now being expanded, in particular as a consequence of the shifting of the third axis of rotation D3, for example by bending up along the support regions 71 and/or at the transitions 78.

In the case of the configuration of the chair without armrests 7, the spring forces of the first spring unit 4 and/or of the second spring unit 5 have to be dimensioned to be adequately higher.

FIGS. 9A and 9C

The slide 26 ends in the unblocked position with the strip 264 thereof virtually flush with the lower edge of the central part 20 and is retracted. The block 263 comes to lie here above the second step 312 of the contour 310 of the backrest bow 3. Owing to the step 312, a clearance 313 remains between the contour 310 and the block 263. If the backrest bow 3 is deflected, the block 263 enters the clearance 313, and therefore the movement toward the maximum back and seat inclination $R_{max}$,$S_{max}$ on the chair is made possible.

FIGS. 9B and 9D

In the blocked position, the slide 26 protrudes with the strip 264 thereof beyond the lower edge of the central part 20 and is therefore extended. The block 263 now sits below the second step 312 of the contour 310 of the backrest bow 3 and bears here against the contour 310. There is therefore no longer a clearance 313 between the contour 310 and the block 263. The backrest bow 3 is therefore locked in the zero position with the minimum back and seat inclination $R_0$,$S_0$.

The efficacy of the first spring unit 4 and second spring unit 5, divided equivalently and independently of each other between the two sides of the chair, and the efficacy of the elasticities, independent of each other on both sides, at the support 6 and at the armrests 7 result in improved comfort by the right and the left shoulder region of the backrest being deformed elastically to differing extents depending on the distribution of weight by the user sitting in the chair.

The invention claimed is:

1. A chair with mutually synchronous adjustment between back inclination and seat inclination, via a region between a respective zero position of back inclination and seat inclination and a respective maximum back inclination and seat inclination, comprising:

a substructure configured to contact a floor;

a base fastened rigidly on the substructure;

a seat support connected to the base, the seat support having a seat region and a back region;

a first backrest bow and a second backrest bow, the first backrest bow and the second backrest bow being fastened on one side to the base and on the other side to the back region of the seat support, wherein the first backrest bow and the second backrest bow are coupled independently of each other to the base on a stationary first axis of rotation;

the seat region of the seat support is coupled to the base on a stationary second axis of rotation;

the first backrest bow and the second backrest bow are coupled independently of each other to the back region of the seat support on an elastically deformable third axis of rotation; and the back region of the seat support is twistable elastically.

2. The chair as claimed in claim 1, further comprising:

a first spring unit which acts counter to the first backrest bow and the second backrest bow; and a second spring unit which is supported at one side on the base in a stationary abutment and which acts at the other side against the first backrest bow and the second backrest bow, the second spring unit being in a parallel connection to the first spring unit.

3. The chair as claimed in claim 1, further comprising:

a first spring unit, the first spring unit being adjustable and having a first spring element and a second spring element; and a second spring unit having a third spring element and a fourth spring element, wherein the base is a U-shaped housing having a central part and a first limb and a second limb extending therefrom, the third spring element is arranged in the first limb and the fourth spring element is arranged in the second limb, and the first axis of rotation runs through the central part while the second axis of rotation extends through a free end of the first limb and a free end of the second limb.

4. The chair as claimed in claim 1, wherein:

the seat support comprises a first strut and a second strut which extend over the seat region and the back region;

upper connecting members through which the third axis of rotation runs are present on the first strut and the second strut in the back region;

central connecting members through which a fourth axis of rotation runs are present on the first strut and the second strut in the seat region; and a first cross strut on which front connecting members are located, through which the second axis of rotation runs, is arranged between the first strut and the second strut in the seat region.

5. The chair as claimed in claim 4, wherein:

the first cross strut is arranged in a front of the seat region and a second cross strut extends between the first strut and the second strut in a rear of the seat region;

the back region is spanned between the first strut and the second strut by a back bow;

the first strut and the second strut, the first cross strut and the second cross strut and the back bow form the seat support as joined individual parts, or the seat support is produced integrally as an injection molded plastics part; and the first strut and the second strut respectively have an elastically deformable region between the seat region and the back region.

6. The chair as claimed in claim 1, further comprising a first armrest and a second armrest, the first armrest and the second armrest being articulated on one side on the third axis of rotation and on the other side on a fourth axis of rotation.

7. The chair as claimed in claim 6, wherein:

the first armrest and the second armrest have a bearing region extending horizontally from the third axis of rotation and a support region extending upward from the fourth axis of rotation such that a transition exists between the bearing region and the support region;

the first armrest and the second armrest support, during a movement of the chair into the maximum back inclination and seat inclination, a damping effect of a first spring unit and a dampening effect of a second spring unit such that during a movement back in a direction of the zero position of back inclination and seat inclination, the first armrest and the second armrest support a restoring force of the first spring unit and a restoring force of the second spring unit; and the first armrest and the second armrest are produced integrally as an injection molded plastics part.

8. The chair as claimed in claim 1, wherein:

a stationary fifth axis of rotation on which a pre-adjustment mechanism for adjusting the intensity of a first spring unit is arranged extends through the base;

a first spring element and a second spring element have a block-shaped body made of elastomer, the first spring element and the second spring element being arranged on an extension of the first backrest bow and an extension of the second backrest bow;

a first displaceable pressure piece and a second displaceable pressure piece are assigned to one of the first spring element and the second spring element, the first displaceable pressure piece and the second displaceable pressure piece being arranged along the fifth axis of rotation on the pre-adjustment mechanism; and the first displaceable pressure piece and the second displaceable pressure piece can be aligned with the first spring element and the second spring element with a selectable degree of congruence by actuation of the pre-adjustment mechanism in order to obtain, during a movement of the chair into the maximum back inclination and seat inclination, a desired damping in accordance with a portion of the first spring element and a portion of the second spring element that are squashed between the extensions and the displaceable pressure pieces, together with an effect of a second spring unit.

9. The chair as claimed in claim 1, further comprising:

a third spring element and a fourth spring element of a second spring unit, the third spring element and the fourth spring element being helical compression springs, wherein the third spring element and the fourth spring element are provided with an end piece having a fixing member which receives an end of the third spring element and an end of the fourth spring element thereby forming a first spring assembly and a second spring assembly; and a sixth axis of rotation on which respective end pieces of the first spring assembly and the second spring assembly are articulated extends through an extension of the first backrest bow and an extension of the second backrest bow.

10. The chair as claimed in claim 1, wherein a first strut and a second strut of the seat support have a groove which runs longitudinally and in which a cover for stretching over the seat support can be fixed.

11. The chair as claimed in claim 1, wherein a height-adjustable pneumatic spring on which the base rests is arranged in the substructure, the pneumatic spring being configured to adjust the seat support to a height corresponding to a need of a user and rotate the seat support about a vertical axis.

* * * * *